US010691076B2

(12) United States Patent
Yonekura et al.

(10) Patent No.: US 10,691,076 B2
(45) Date of Patent: Jun. 23, 2020

(54) ELECTRONIC TIMEPIECE

(71) Applicant: CASIO COMPUTER CO., LTD., Tokyo (JP)

(72) Inventors: Takaomi Yonekura, Akiruno (JP); Tadashi Kojima, Musashimurayama (JP); Takayasu Akagi, Hino (JP); Shinji Saito, Yokohama (JP); Hirofumi Nagareda, Tachikawa (JP); Hirohisa Maruyama, Fuchu (JP); Junichi Izumi, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 21 days.

(21) Appl. No.: 15/989,552

(22) Filed: May 25, 2018

(65) Prior Publication Data

US 2018/0275614 A1 Sep. 27, 2018

Related U.S. Application Data

(63) Continuation of application No. 15/223,688, filed on Jul. 29, 2016, now Pat. No. 10,007,236.

(30) Foreign Application Priority Data

Sep. 2, 2015 (JP) ..... 2015-172991
May 20, 2016 (JP) ..... 2016-101084

(51) Int. Cl.
*G04G 9/00* (2006.01)
*G04R 20/30* (2013.01)
(Continued)

(52) U.S. Cl.
CPC ..... *G04G 9/0076* (2013.01); *G04R 20/30* (2013.01); *G04C 3/14* (2013.01); *G04R 20/26* (2013.01)

(58) Field of Classification Search
CPC ..... G04G 9/0076; G04B 19/22; G04B 19/223
See application file for complete search history.

(56) References Cited

U.S. PATENT DOCUMENTS 8,576,670 B2 11/2013 Akiyama
2005/0105397 A1 5/2005 Tuason
(Continued)

FOREIGN PATENT DOCUMENTS

JP 2834191 B2 12/1998
JP 2006-266987 A 10/2006

OTHER PUBLICATIONS

U.S. Notice of Allowance dated Feb. 26, 2018 received in related U.S. Appl. No. 15/223,688.
(Continued)

*Primary Examiner* — Daniel P Wicklund
(74) *Attorney, Agent, or Firm* — Scully Scott Murphy & Presser

(57) ABSTRACT

An electronic timepiece includes indicators, an operation receiving unit, a timing unit and a processor. The operation receiving unit receives an operation performed by a user. The timing unit counts a date and time at present. The processor carries out operation control of the indicators and obtains a local time setting based on a time difference between a predetermined standard time and a local time at a target position. The processor makes at least apart of the indicators display the local time in accordance with the operation received by the operation receiving unit and obtains the local time setting based on a difference between the displayed local time and the date and time counted by the timing unit.

9 Claims, 15 Drawing Sheets

(51) Int. Cl.
*G04R 20/26* (2013.01)
*G04C 3/14* (2006.01)

(56) References Cited

U.S. PATENT DOCUMENTS

| | | | | |
|---|---|---|---|---|
| 2009/0135675 | A1 | 5/2009 | Akiyama | |
| 2011/0280108 | A1 | 11/2011 | Honda | |
| 2013/0077448 | A1* | 3/2013 | Matsuo | G04R 20/12 368/21 |
| 2014/0092714 | A1* | 4/2014 | Nagareda | G04C 3/14 368/187 |
| 2015/0253739 | A1* | 9/2015 | Iida | G04G 9/00 368/80 |
| 2016/0018789 | A1 | 1/2016 | Hasegawa | |
| 2016/0041530 | A1 | 2/2016 | Morohoshi | |
| 2016/0209813 | A1 | 7/2016 | Hasegawa | |
| 2016/0259302 | A1 | 9/2016 | Tezuka | |
| 2016/0266553 | A1 | 9/2016 | Hasegawa | |
| 2017/0176952 | A1* | 6/2017 | Misaki | G04G 9/0076 |
| 2017/0261934 | A1* | 9/2017 | Matsuzawa | G04B 19/04 |
| 2019/0079461 | A1* | 3/2019 | Maruyama | G04C 3/14 |
| 2019/0094814 | A1* | 3/2019 | Oikawa | G04G 5/002 |

OTHER PUBLICATIONS

Notice of Reasons for Refusal dated Mar. 31, 2020 received in Japanese Patent Application No. JP 2016-101084 together with an English language translation.

* cited by examiner

ELECTRONIC TIMEPIECE

CROSS REFERENCE TO RELATED APPLICATION

This application is a continuation application of U.S. application Ser. No. 15/223,688 filed on Jul. 29, 2016, which is based upon and claims the benefit of priority under 35 USC 119 of Japanese Patent Application No. 2015-172991 filed on Sep. 2, 2015 and Japanese Patent Application No. 2016-101084 filed on May 20, 2016, the entire disclosures of which, including the descriptions, claims, drawings and abstracts, are incorporated herein by reference in their entirety.

BACKGROUND OF THE INVENTION

1. Field of the Invention

The present invention relates to an electronic timepiece.

2. Description of Related Art

Traditionally, there is known an electronic timepiece including a world clock time function which calculates and displays date and time (local time) of various places in the world. In such electronic timepiece, by selecting and setting a city in the world, the time difference between the local time of the city and the Coordinated Universal Time (UTC date and time) is calculated with reference to the time zone to which the city belongs and the summer time rule of the city to obtain and display the local time.

For example, in the electronic timepiece disclosed in JP 2006-266987A, when carrying out the above city setting, one of the abbreviated names of the cities displayed on the dial (fixed dial), the bezel or the like is indicated by a predetermined indicator to select the city and to calculate its local time.

Traditionally, in order to display local times of various cities of the world, it is necessary to know in advance in which time zone the target city belongs to. Specifically, with respect to the areas other than the cities which can be displayed on the bezel or the like, there is a problem that a user has to go through a trouble of looking up such relation between the target area and the time zone. Further, for users other than those who know the world geography very well and those who visit the same area repeatedly, it is difficult to understand which abbreviation indicates which city and need to root up the description and the like causing great trouble leading to a problem that the correct local time cannot be displayed easily.

SUMMARY OF THE INVENTION

An object of the present invention is to provide an electronic timepiece which can reduce the trouble which a user has to go through and which can easily calculate and display dates and times of various cities of the world.

In order to realize the above object, according to a first aspect of the present invention, there is provided an electronic timepiece, including:

a plurality of indicators;

an operation receiving unit which receives an operation performed by a user;

a timing unit which counts a date and time at present; and a processor which carries out operation control of the plurality of indicators and which obtains a local time setting based on a time difference between a predetermined standard time and a local time at a target position, the local time being a regional time at a place in a world, wherein the processor makes at least a part of the plurality of indicators display the local time in accordance with the operation received by the operation receiving unit and obtains the local time setting based on a difference between the displayed local time and the date and time counted by the timing unit.

According to the present invention, there is advantage that the trouble which a user has to go through can be reduced and dates and times of various cities of the world can be calculated and displayed easily.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described on the basis of the drawings.

Figure 1:
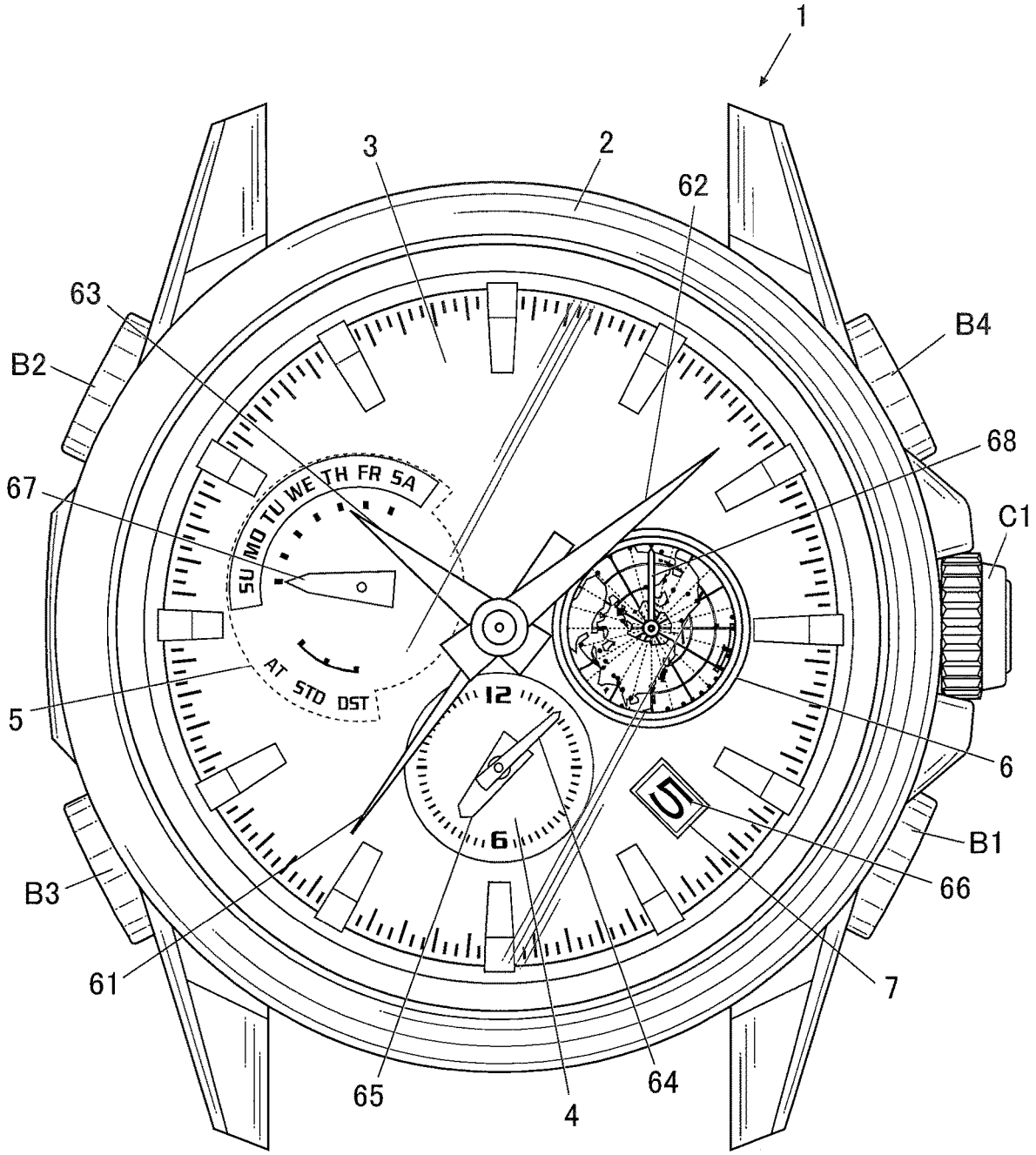
FIG. 1 is a plan view of an electronic timepiece according to the present invention.

FIG. 1 is a front view of the electronic timepiece 1 according to the embodiment.

The electronic timepiece 1 includes a casing 2, a fixed dial 3, a second hand 61, a minute hand 62, an hour hand 63, a sub-minute hand 64, a sub-hour hand 65, a date wheel 66, a mode indicator 67, a map indicator 68 (map indicating unit), a crown C1 and push button switches B1 to B4. The upper surface of the electronic timepiece 1 is covered with a transparent windproof glass (not shown).

Hereinafter, a part of or all of the second hand 61, minute hand 62, hour hand 63, sub-minute hand 64, sub-hour hand 65, date wheel 66, mode indicator 67 and map indicator 68 are also referred to as the indicators 61 to 68 all together, for example.

The casing 2 houses individual components of the electronic timepiece 1 inside thereof. The fixed dial 3 is housed in the casing 2 so that the surface of the fixed dial 3 on which indexes (hourmarks) for indicating time are provided be visually recognized through the windproof glass. The indicators 61 to 65, 67 and 68 are provided between the fixed dial 3 and the windproof glass. The date wheel 66 is provided on the surface which is the other side of the display surface of the fixed dial 3.

The crown C1 and the push button switches B1 to B4 are provided so as to protrude the side surface of the casing 2, and operation performed externally can be transmitted inside the casing 2.

At a position in the direction of 4:30 on the fixed dial 3, an opening 7 is provided. Any one of the index (aftermentioned date index) which are arranged on the fixed dial 3 side surface of the date wheel 66 can be visually recognized through the opening 7. Further, the sub-windows 4, 5 and 6 are provided at the positions in the directions of 6 o'clock, 9:30 and 3 o'clock, respectively, in the fixed dial 3.

The second hand 61, the minute hand 62 and the hour hand 63 rotate on the surface parallel to the fixed dial 3 with the approximate center of the fixed dial 3 being the rotational axis. In a normal display state, the second hand 61, the minute hand 62 and the hour hand 63 are used to display the present local time (home time) which is the regional time at the present position.

The sub-minute hand 64 and the sub-hour hand 65 are used to display the regional time (world time clock) of any of the area in the world (world time clock position).

On the date wheel 66, the date indexes of "1" to "31" are arranged on circumference thereof with equal intervals therebetween. The date wheel 66 is a rotating plate in a disk shape which indicates the date of the present position by any one of the date indexes being exposed from the opening 7 due to the date wheel 66 being rotated.

The mode indicator 67 rotates in the sub-window 5. In a normal display state, the mode indicator 67 points to the present day of the week at the present position. The mode indicator 67 is also used to select the setting of summer time. By the mode indicator 67 pointing to the index "AT", it can be known that the on/off of summer time can be switched in accordance with the summer time rule which is obtained in advance. By the mode indicator 67 pointing to the index "STD" or the index "DST", the setting is to be fixed to the summer time not-set state or the summer time set state, respectively, regardless of the summer time rule set at the present position and the world time clock position. The time shift which needs to be considered when manually setting the summer time may be set manually separately or may be set to a fixed uniform time. For example, the time shift may be set to 1 hour. Alternatively, as described later, the time shift may be determined or estimated on the basis of the information on the time difference between the time during the period when summer time is being set and the UTC date and time.

The map indicator 68 rotates in the sub-window 6, and points to the time zone according to the world time clock position or the present position. For example, the map indicator 68 can be controlled so as to point to the time zone according to the world time clock position in the normal state and to point to the time zone according to the present position when the present position is being set manually.

Figure 2:
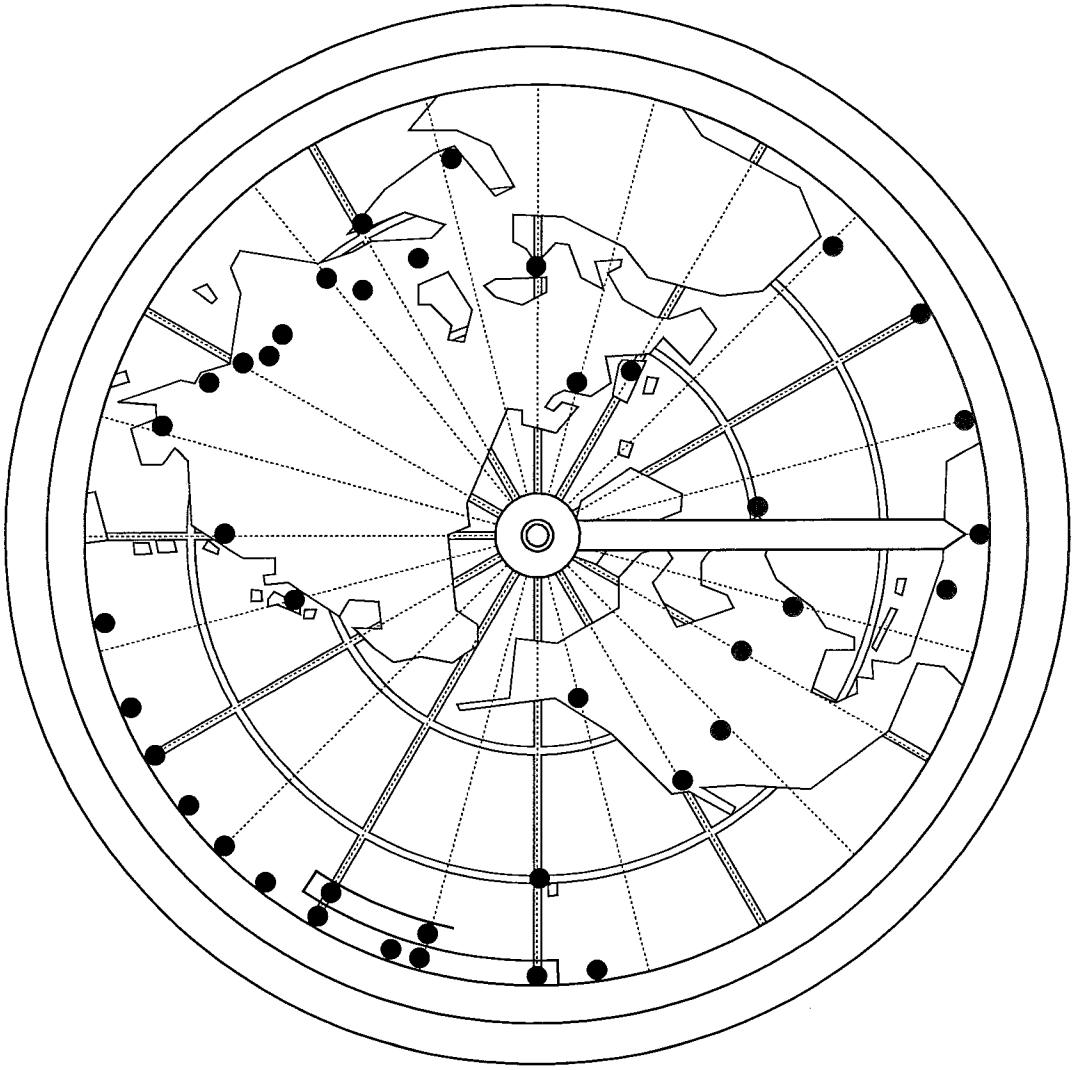
FIG. 2 shows a world map display in a sub-window.

FIG. 2 shows the inside of the sub-window 6 in detail.

In the sub-window 6, the world map (map image) including the city indexes (here, circle marks) indicating the areas (cities) included in individual time zones of the world is shown. Here, although only the map of the north hemisphere with the north pole being the center is shown, the south hemisphere may also be shown together. For example, the coastal lines and city indexes of the south hemisphere may be overlapped on the coastal lines and city indexes of the north hemisphere in different color in the sub-window 6. Alternatively, the map of the south hemisphere may be arranged outside of the equator or the polarization state may be processed so that either of the north and south hemispheres can be shown according to the angle from which a user is looking at the timepiece. Alternatively, the sub-dial in the sub-window 6 may be moved to selectively display either of the north and south hemispheres or another sub-window 6 may be provided so as to form a set with the original sub-window 6 to separately display the north and south hemispheres in the sub-windows 6.

In each time zone, at least one city is set so as to be associated with the time zone. Although these cities are not necessarily arranged by having equal intervals in the longitude direction, the relation between the individual cities and the time zones may be set so as to be easily understood by adjusting the intervals between the city indexes by deforming the shape of the coastal lines, for example. Further, since the areas whose local times are +12 hours to +14 hours with respect to the UTC (Coordinated Universal Time) and the areas whose local times are −10 hours to −12 hours with respect to the UTC (Coordinated Universal Time) are mixed, such difference may be discriminated by different colors and shapes of the city indexes. Alternatively, the city indexes may be uniform. In any case, any one of the cities can be selectively set by rotating the map indicator 68 at the time when setting the time zone.

Figure 3:
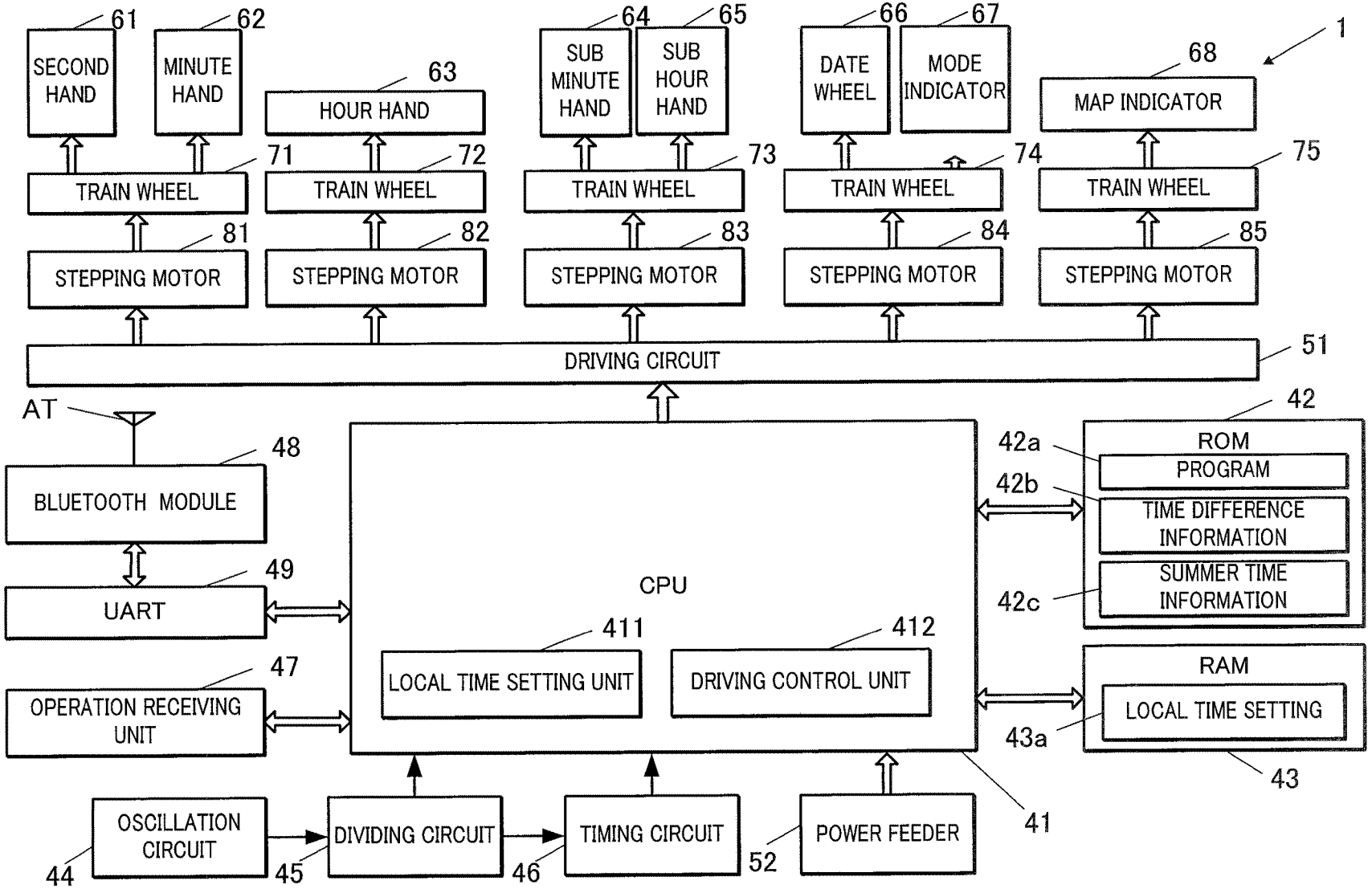
FIG. 3 is a block diagram showing a functional configuration of the electronic timepiece.

FIG. 3 is a block diagram showing a functional configuration of the electronic timepiece 1 according to the embodiment.

In addition to the indicators/pointers 61 to 68, the electronic time piece 1 includes train wheels 71 to 75, stepping motors 81 to 85, a driving circuit 51, a CPU 41 (Central Processing Unit)(local time setting unit 411, driving control unit 412) as a processor, a ROM 42 (Read Only Memory), a RAM 43 (Random Access Memory), an oscillation circuit 44, a dividing circuit 45, a timing circuit 46 (timing unit), an operation receiving unit 47, a Bluetooth module 48, an UART 49 (Universal Asynchronous Receiver/Transmitter), an antenna AT, a power feeder 52 and the like. The CPU 41 includes the local time setting unit 411 and the driving control unit 412. The local time setting unit 411 and the driving control unit 412 may be a single CPU or may be separate CPUs which carry out individual operation.

The CPU 41, the ROM 42 and the RAM 43 form the processor.

The stepping motor 81 makes the second hand 61 and the minute hand 62 rotate in conjunction with each other via the train wheel 71. The stepping motor 82 makes the hour hand 63 rotate via the train wheel 72. The stepping motor 83 makes the sub-minute hand 64 and the sub-hour hand 65 rotate in conjunction with each other via the train wheel 73. The stepping motor 84 makes the date wheel 66 and the mode indicator 67 rotate in conjunction with each other via the train wheel 74. Since the ratio between rotation angles of the date wheel 66 and the mode indicator 67 differ greatly, rotation of the date wheel 66 can be ignored when the mode indicator 67 is being operated and the mode indicator 67 may rotate for a predetermined number of times according to the above mentioned ratio when changing the date which is to be displayed by the date wheel 66. The stepping motor 85 makes the map indicator 68 rotate via the train wheel 75.

The CPU 41 performs various arithmetic processes and integrally controls the entire operation of the electronic timepiece 1. The CPU 41 appropriately sets the time difference between the UTC date and time and the time at the present position and the time at the world time clock position on the basis of a local time setting 43*a*, and converts the UTC date and time which the timing circuit 46 counts to an appropriate local time. The CPU 41 outputs a control signal to the driving circuit 51 at an appropriate timing to operate the indicators 61 to 67 in order to display the obtained local time. The CPU 41 further controls the driving circuit 51 to rotate the map indicator 68 in accordance with the local time setting 43*a* in order to display the time zone of the world time clock position and the present position.

The ROM 42 is a mask ROM, various types of non-volatile memory or the like, and a program 42*a* for controlling, default setting data and the like are stored in the ROM 42. Default setting data includes time difference information 42*b* and summer time information 42*c*. If a city of the present position or the world time clock position is selected, the time zone corresponding to the city is obtained from the time difference information 42*b* and the summer time rule is obtained from the summer time information 42*c*. If the update information and additional setting information on the time zone and the summer time rule are obtained externally, such update information is stored in the non-volatile memory of the ROM 42 or in the RAM 43.

The RAM 43 provides a working memory space for the CPU 41 and temporary data is stored here. Such temporary data includes the local time setting 43*a*, and the city which is selected as the present position or the world time clock position and the local time setting (time zone and summer time rule) of the city are stored here. As for the RAM 43, other non-volatile memories in which high speed data writing can be performed may be used, partially, in addition to regular volatile memory such as DRAM, SRAM and the like.

The oscillation circuit 44 generates and outputs a pulse signal of a predetermined frequency (16 kHz, 32 kHz or the like).

The dividing circuit 45 divides the pulse signal which is generated by the oscillation circuit 44, reduces the frequency, converts the divided pulse signal into a clock signal of the frequency which the CPU 41 and the timing circuit 46 uses and outputs the clock signal.

The timing circuit 46 counts the present date and time by counting the predetermined frequency signal which is input from the dividing circuit 45 and adding the counted frequency signal to the default date and time. Here, the timing circuit 46 counts the date and time by the standard time, that is, the UTC date and time. The CPU 41 converts the date and time counted by the timing circuit 46 into each local time to be used for display and the like.

The operation receiving unit 47 detects the operation performed on the crown C1 and the push button switches B1 to B4, converts the detected operation into an electric signal and outputs the electric signal to the CPU 41. Operation to the crown C1 includes two-step pulling operation, pushing-in operation and rotating operation in both directions.

The Bluetooth module 48 is a module relating to data transmission and reception process for carrying out close distance radio communication with an external device by using Bluetooth (registered trademark). The Bluetooth module 48 obtains information relating to the present date and time, newly set present position and world time clock position, the updated time zone and summer time period (set or not-set) information corresponding to the above positions from an external device on the bases of the controlling of the CPU 41. The UART 49 performs serial/parallel conversion on the data to be transmitted and received between an external device and sends the converted data to the CPU 41. The antenna AT is used for communication carried out by Bluetooth and performs transmission and reception of radio waves of the communication frequency.

Although it is not specifically limited, as for an external device which is to be connected by the Bluetooth module 48, an electronic device which can maintain sufficient accuracy of the present date and time and which can update the present position information in real time as possible (for example, the time needed to reflect the change in present position is within about several seconds to several minutes) is needed when obtaining the present date and time and the present position information. Preferably, smartphones, mobile phones and the like are selected. These smartphones and mobile phones can receive radio waves from positioning satellites, can obtain present position information from base stations of mobile phone communication (hereinafter, these are called the positioning operation all together), and may update the present date and time as needed on the basis of the synchronized information between the base station of the mobile phone communication.

The driving circuit 51 outputs driving signals to operate the stepping motors 81 to 85 at appropriate timings according to the control signals from the CPU 41. The driving circuit 51 can output pulse signals of set appropriate peak voltages and peak voltage lengths to individual stepping motors 81 to 85. Further, in the case where control signals for driving a plurality of indicators at the same time is obtained, the driving circuit 51 can operate the plurality of stepping motors by slightly shifting the timings according to the level of the loads.

The power feeder 52 supplies power to each components of the CPU 41. The power feeder 52 includes a battery. The battery may be a battery formed by a solar panel and a secondary cell being combined or may be a button type dry-cell battery. With respect to the power to a component which operates intermittently such as the Bluetooth module 48, the power supply can be cut off if not needed.

Next, setting operation of local time in the electronic timepiece 1 according to the embodiment will be described.

In the electronic timepiece 1, the information relating to the present position (city) and the present time (local time)

of the present position are obtained by being connected to and communicating with an external device such as a smartphone via Bluetooth regularly (for example, once a day) or according to user's connecting operation. In a state where the external device can perform positioning operation, the electronic timepiece 1 obtains the correct present position and present time at the timing when communicating with the external device. At this time, the electronic timepiece 1 may also obtain the updated time zone information and summer time rule, for example, based on the data held in the external device.

In the case where local time is obtained from an external device, the CPU 41 back calculates the UTC date and time on the basis of the updated local time setting 43*a* and corrects the date and time counted by the timing circuit 46. Alternatively, the present time obtained from a smartphone may be the UTC date and time and not local time. In such case, the date and time counted by the timing circuit 46 is directly corrected according to the UTC date and time, and the local time of the present position is calculated and displayed according to the updated local time setting 43*a*.

In the cases where the positioning operation is difficult to be carried out by an external device such as being inside a room, at a basement or the like or where a user does not have an external device with her/him, the user can manually change and set the local time (present position). In the electronic timepiece 1, by performing an operation to change the time display to the present time (local time) of the present position (the target position to obtain the local time) in the state where the present position is set, the time difference between the new UTC date and time is calculated without changing the UTC date and time itself counted by the timing circuit 46, and the information such as the time zone and the like are back calculated.

Figure 4:
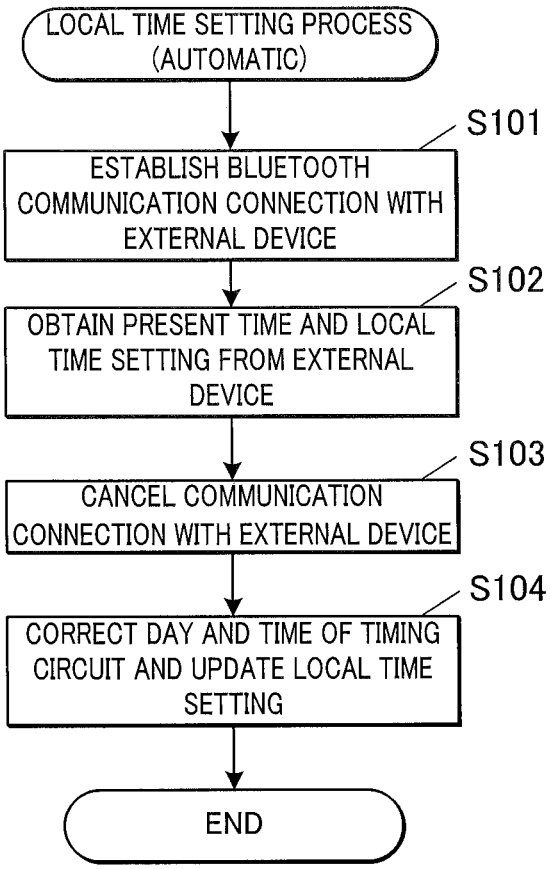
FIG. 4 is a flowchart showing a controlling procedure of a local time setting process (automatic)

FIG. 4 is a flowchart showing a controlling procedure of a local time setting process (automatic) executed in the electronic timepiece 1 according to the embodiment, the controlling procedure being carried out by the CPU 41.

The local time setting process (automatic) is called up and activated once a day at the predetermined time.

When the local time setting process (automatic) is activated, the CPU 41 establishes a communication connection with a preset external device, such as a smartphone, via Bluetooth (step S101). The CPU 41 obtains the local time setting of the present date and time and present position of the UTC from the external device with which communication connection is established (step S102).

The CPU 41 cancels the communication connection with the external device (step S103), corrects the date and time counted by the timing circuit 46 on the basis of the obtained present time and stores the obtained local time setting as the local time setting 43*a* (step S104). Then, the CPU 41 ends the local time setting process (automatic).

In such way, on the basis of the updated local time setting 43*a* and the corrected date and time calculated by the timing circuit 46, the present date and time displayed by the indicators 61 to 63, 66 and 67 and the world time clock displayed by the indicators 64 and 65 are corrected.

Figure 5:
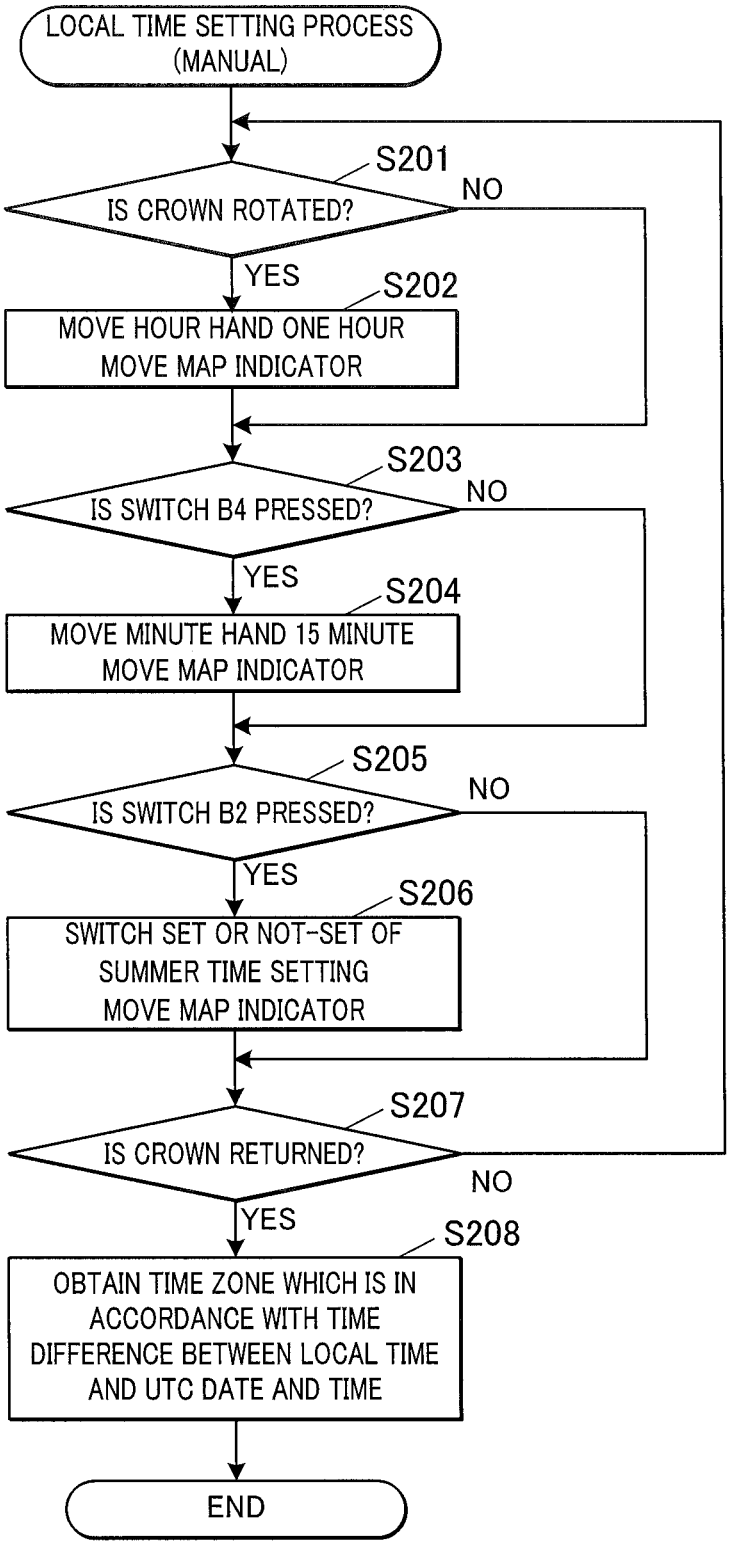
FIG. 5 is a flowchart showing a controlling procedure of a local time setting process (manual)

FIG. 5 is a flowchart showing a controlling procedure of a local time setting process (manual) which is executed in the electronic timepiece 1 according to the embodiment, the controlling process being carried out by the CPU 41.

This local time setting process (manual) is activated by a predetermined operation for switching to the local time setting state being performed by a user and here, such operation is the operation of two-step pulling out of the crown C1, for example.

If the local time setting process (manual) is activated, the CPU 41 determines whether the rotating operation of the crown C1 is detected (step S201). If the CPU 41 determines that the rotating operation of the crown C1 is detected (step S201; YES), the CPU 41 determines the moving direction on the basis of the detected rotating direction of the crown C1, outputs a control signal to the driving circuit 51, moves the hour hand 63 for one hour in the determined moving direction and moves the map indicator 68 to the position to point to the city index of the time zone that is different by one hour (step S202). Then, the process of the CPU 41 moves on to step S203. If the CPU 41 determines that the rotating operation of the crown C1 is not detected (step S201; NO), the process of the CPU 41 moves on to step S203.

The CPU 41 determines whether the push button switch B4 is pushed (step S203). If the CPU 41 determines that the push button switch B4 is pushed (step S203; YES), the CPU 41 outputs a control signal to the driving circuit 51 to make the second hand 61 and the minute hand 62 proceed 15 minutes and at the same time, moves the map indicator 68 to the position corresponding to the time zone which is proceeded by 15 minutes (step S204). Although time zones are set in units of 15 minute with respect to the UTC time, there are times zones that do not exist. With respect to the time zones which are presently set, the CPU 41 may make the map indicator 68 point to the corresponding city indexes. With respect to the time zones that are not set, the CPU 41 may make the map indicator 68 point to the positions set by equally dividing the spaces between the two adjacent city indexes in units of 15 minutes.

At this time, in the case where pushing of the push button switch B4 is detected in the state where the minute hand 62 is at the position of 45 minute, the CPU 41 makes the minute hand return to the position of 0 minute without making the hour hand 63 proceed to the next hour and at the same time, the CPU 41 makes the map indicator 68 return to the index position indicating the time zone corresponding to the position of 0 minute. The hour hand 63 may or may not be moved with the periodical moving of the minute hand 62 for 45 minutes.

When the process of step S204 ends, the process of the CPU 41 moves on to step S205. If the CPU 41 determines that the push button switch B4 is not pushed in the determining process of step S203 (step S203; NO), the process of the CPU 41 moves on to step S205.

When moved on to the process of step S205, the CPU 41 determines whether the push button switch B2 is pushed (step S205). If the CPU 41 determines that the push button switch B2 is pushed (step S205; YES), the CPU 41 switches the setting relating to set or not-set of summer time and at the same time, outputs a control signal to the driving circuit 51 to move the mode indicator 67 to the indicating position according to the switching. If the summer time is being set, the CPU 41 outputs a control signal to the driving circuit 51 to make the map indicator 68 point to the time zone which correspond to the present time taking the summer time into consideration (step S206).

Currently, in almost all of the areas in the world where has summer time, time shift of +1 hour is set with respect to the regular time difference during the period when summer time is being set. Thus, the time zone corresponding to each of these area will be the area where the time difference is −1 hour from the time difference between the time displayed by the indicators 61 to 63 and the UTC time. However, only in the case where the time difference is the UTC+11 hours, there are Australian Eastern Standard Time which is shifted by +1 hour with respect to the time difference of +10 hours and Lord How Island whose time is shifted by 30 minutes with respect to the time difference of +10 hours and 30 minutes. Thus, in these cases, these two areas may be sequentially selected in accordance with the pushing operation of the push button switch B2. Alternatively, other operation may be performed to change the +1 hour time shift caused by summer time being set. In such way, time shift other than +1 hour can be associated with other areas newly set as needed.

Here, if the local time setting process (manual) is called when summer time setting is set to auto ("AT"), summer time setting is automatically switched to manually turned off state ("STD"). However, summer time setting may simply maintain the present setting or may be automatically switched by determining whether it is a period where there is a possibility that summer time is being set by referring to separate date and time information and determination information on south/north hemisphere (latitude) which is obtained separately. In the case where a plurality of cities can be selected individually in the same time zone, the CPU 41 can determine whether summer time is being set for each city. In such case, the CPU 41 can move the mode indicator 67 in conjunction with the map indicator 68 to the position according to set or not-set of summer time.

When the process of step S206 ends, the process of the CPU 41 moves on to step S207. If the CPU 41 determines that the push button switch B2 is not pushed in the determining process of step S205 (step S205; NO), the process of the CPU 41 moves on to step S207.

When moved on to the process of step S207, the CPU 41 determines whether the crown C1 is pushed and returned from the two-step pulled out state (step S207). If the CPU 41 determines that the pushing and returning of the crown C1 is not detected (step S207; NO), the process of the CPU 41 returns to step S201. If the CPU 41 determines that the pushing and returning of the crown C1 is detected (step S207; YES), the CPU 41 obtains the time difference between the time indicated by the indicators 61 to 63 and the UTC date and time counted by the timing circuit 46 and the time zone information according to the setting relating to set or not-set of summer time which is finally set in the process of step S206 and updates the local time setting 43*a* (step S208). At this time, the CPU 41 may refer to the time difference information 42*b* and the summer time information 42*c* and select the corresponding city or may not carry out the city setting.

The CPU 41 outputs a control signal to the driving circuit 51 so as to match the indicators 61 to 66 to the present date and time in accordance with the time elapsed while executing the local time setting process (manual). Further, if there is a change in the date, the CPU 41 moves the date wheel 66 to the changed date position and then, outputs a control signal to the driving circuit 51 so as to move the mode indicator 67 to the position indicating the present day of the week at the present position. Then, the CPU 41 ends the local time setting process (manual).

FIGS. 6A, 6B and FIGS. 7A, 7B show display examples of when the local time setting process (manual) is being executed.

Here, the second hand 61 and the sub-minute hand 64 and the sub-hour hand 65 in the sub-window 4 relating to the world time clock function are omitted in the drawings.

Figure 6A:
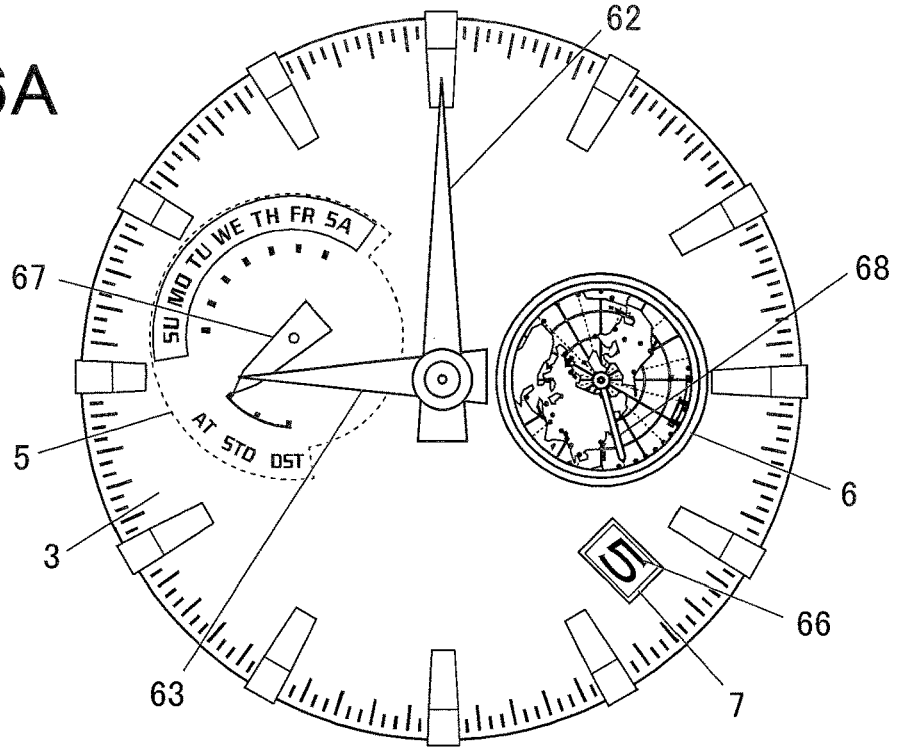
FIG. 6A shows a display example of when the local time setting process (manual) is being executed.

First, if the two-step pulling out of the crown C1 is performed, the electronic timepiece 1 stops in the state where the present time (local time) of the present position at this time being displayed by the indicators 62 and 63 and at the same time and the set time zone (corresponding city index) being pointed by the map indicator 68 as shown in FIG. 6A. Here, the map indicator 68 shows that Tokyo (UTC+9) is being set and it is shown that the present time is 9:00. That is, the UTC date and time at this time are 0:00 on the same day as the local time of Tokyo.

Figure 6B:
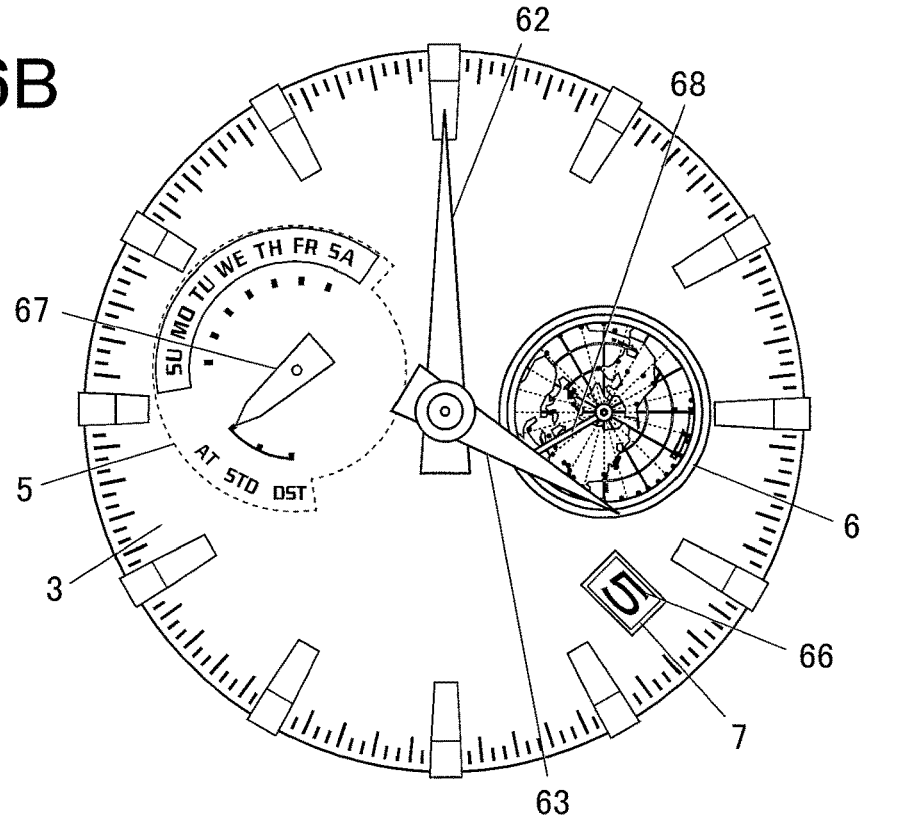
FIG. 6B shows a display example of when the local time setting process (manual) is being executed.

If the crown C1 is rotated in the above state (step S201; YES), as shown in FIG. 6B, the hour hand 63 is made to move sequentially by 1 hour and the map indicator 68 is made to point to the cities in different time zones which differ by 1 hour accordingly (step S202). Here, the indicators/pointers 62 and 63 indicate that the time zone where the present time is 4:00 is set and the map indicator 68 indicates the city corresponding to the area of +4 hours with respect to the UTC date and time, here, the map indicator 68 points to Dubai in United Arab Emirates.

Figure 7A:
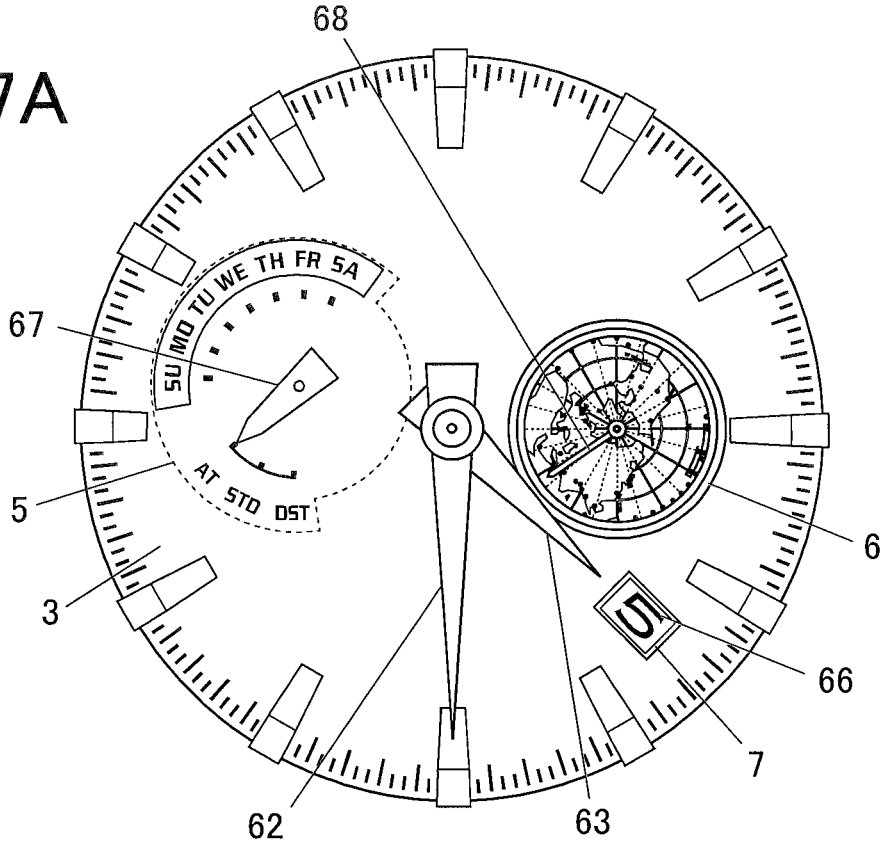
FIG. 7A shows a display example of when the local time setting process (manual) is being executed.

Next, if the push button switch B4 is pushed (step S203: YES), the minute hand 62 is moved sequentially by 15 minutes and accordingly, the map indicator 68 is made to point to the positions of different time zones which differ by 15 minutes (step S204) as shown in FIG. 7A. Here, by the push button switch B4 being pushed twice, the minute hand 62 is moved for 30 minutes and this indicates that the time zone where the present time is 4:30 is set. Accordingly, the map indicator 68 points to the city corresponding to the area of +4 hours and 30 minutes with respect to the UTC date and time, here, the map indicator 68 points to Kabul in Afghanistan.

Figure 7B:
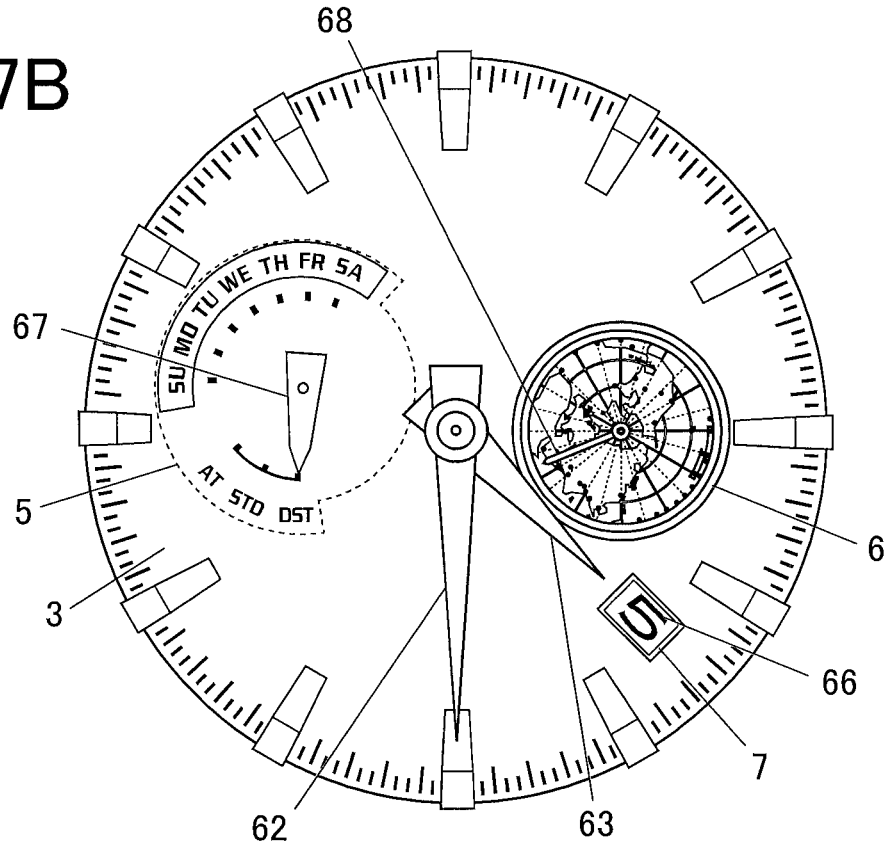
FIG. 7B shows a display example of when the local time setting process (manual) is being executed.

Further, if the push button switch B2 is pushed (step S205; YES) the mode indicator 67 is moved as shown in FIG. 7B (step S206) Every time the push button switch B2 is pushed, the mode indicator 67 switches between the index "STD" and the index "DST". Accordingly, the summer time set state and the summer time not-set state are switched between each other. In the default state, the summer time rule is automatically applied and either one can be indicated first in the case where the index "AT" is being pointed.

In the case where the mode indicator 67 points to the index "DST" and the summer time set state is set, the time indicated by the hour hand 63 and the minute hand 62 is determined as the time in which the summer time is taken into consideration. In such case, the time difference of +4 hours and 30 minutes with respect to the UTC date and time is determined as being the combination of the time difference of +3 hours and 30 minutes due to the difference in time zone and +1 hour time shift due to the summer time being set. In such way, the CPU 41 moves the map indicator 68 and makes the map indicator 68 point to Tehran in Iran which is the city corresponding to the area whose time difference is +3 hours and 30 minutes.

If the returning of the crown C1 is detected (step S207: YES), the CPU 41 obtains the information which is finally set in the state shown in FIG. 1B, that is, obtains that the present position is in the time zone of +3 hours and 30 minutes with respect to the UTC time and is in the area where the summer time is being set and stores the information in the local time setting 43*a* (step S208). At this time, the CPU 41 may refer to the time difference information 42*b* and the summer time information 42*c* to set "Tehran" as the city corresponding to the area. Then, the CPU 41 restarts the operation of displaying the date and time according to the present date and time counted by the timing circuit 46 by the indicators 61 to 67 in real time. At this time, the date display by the date wheel 66 and the day display by the mode indicator 67 can be switched as needed. Further, the map indicator 68 is to be in the display state of pointing to the time zone according to the set position in the world time clock.

As described above, the electronic timepiece 1 of the embodiment includes a plurality of indicators/pointers 61 to 68, the CPU 41, the operation receiving unit 47 which receives operation performed by a user and the timing circuit 46 which counts the present date and time. The CPU 41 operates as the driving control unit 412 which controls the operation of the plurality of indicators 61 to 68. The CPU 41 further operates as the local time setting unit 411 which obtains out the local time setting on the basis of the time difference between the UTC date and time and the local time at the target position, the local time being the regional time at a place in the world.

As the driving control unit 412, the CPU 41 makes at least a part of the plurality of indicators 61 to 68, which are the minute hand 62 and the hour hand 63, display the local time desired by a user in accordance with the operation received by the operation receiving unit 47. As the local time setting unit 411, the CPU 41 obtains local time setting on the bases of the difference between the displayed local time and the date and time counted by the timing circuit 46.

In such way, just by a user moving the minute hand 62 and the hour hand 63 so as to display the present time (local time) of the area which is the target area to be changed, the corresponding time zone setting can be obtained. Thus, a user does not need to go through a trouble of looking up the specific time difference and the city representing the time zone of the time difference. Further, since only the setting of time zone is switched, the date and time counted by the timing circuit 46 which has been originally counted, the functions which has been set, time display of the world time clock and the like will not be changed or influenced and counting and displaying of the appropriate date time can be maintained.

Further, the CPU 41 as the local time setting unit 411 appropriately takes the time shift due to summer time being set at the time when determining the time zone in accordance with the setting relating to set or not-set of summer time into consideration in the local time setting process. Thus, an appropriate setting of time zone can be carried out even if the local time which is displayed by user's operation is the local time with summer time being set without causing any changes. Further, according to such setting, the local time reflecting an appropriate summer time rule can be counted and displayed by referring to the summer time information 42*c*.

The CPU 41 as the local time setting unit 411 can switch the setting relating to set or not-set of summer time in accordance with the operation received by the operation receiving unit 47. That is, in the case where a user knows whether the set local time is during when summer time is being set, the setting of time zone which appropriately taking the time shift due to summer time being set into consideration can be carried out easily and reliably just by simply switching between on/off of the setting relating to set or not-set of summer time.

The electronic timepiece 1 includes the world map in the sub-window 6 and the map indicator 68 which indicates any one of the time zones in the world map. The CPU 41 as the driving control unit 412 moves the world map and the map indicator relative to each other by rotating the map indicator 68, and makes the map indicator 68 point to the position on the world map indicating the time zone corresponding to the local time setting which is obtained by the CPU 41 as the local time setting unit 411.

In such way, there is no need for a user to determine the abbreviation (symbols) of individual cities and know the positional relation between the individual cities and the time zone where the user is at, and whether the time zone of the desired are is set can be known easily.

In the case where the setting relating to summer time is switched, the CPU 41 as the driving control unit 412 only determines the time zone again without changing the local time and makes the map indicator 68 point to the position on the world map corresponding to the determined time zone.

In such way, since the time zone is determined and displayed reliably in accordance with the setting of summer time, a user can easily read the setting of time zone by looking at the map indicator 68.

Second Embodiment

Next, the electronic timepiece according to the second embodiment will be described.

Figure 8:
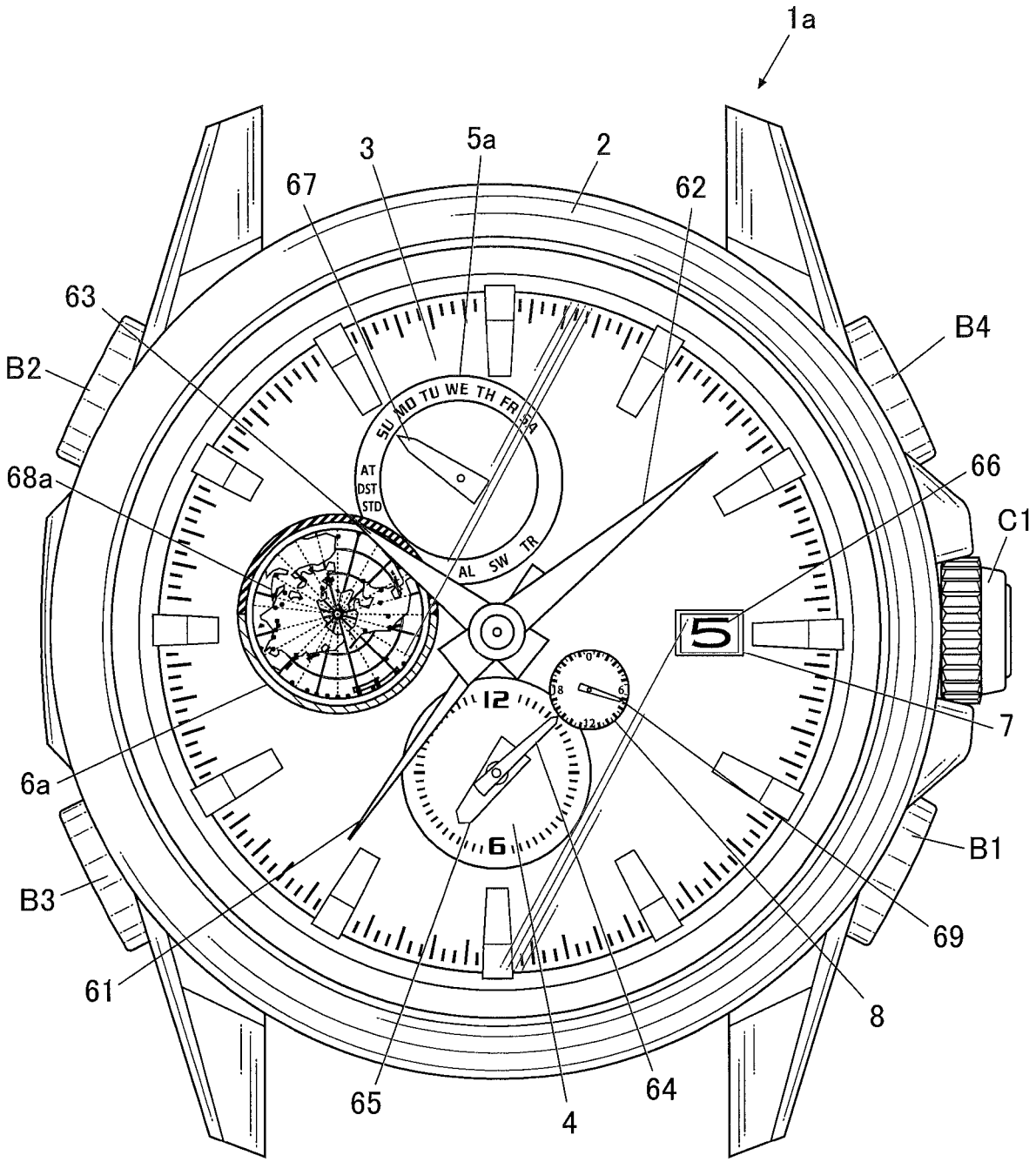
FIG. 8 is a front view of an electronic timepiece according to the second embodiment.

FIG. 8 shows the front view of the electronic timepiece 1*a* according to the second embodiment.

In the electronic timepiece 1*a*, a sub-window 6*a* is provided on the 9 o'clock side. The map indicator 68 is not provided in the sub-window 6*a* and the map disk 68*a* (rotational disk) on which the map is drawn (formed) is provided so as to rotate.

The sub-window 5*a* and the mode indicator 67 (setting indicator) which rotates in the sub-window 5*a* are provided at the position slightly toward the sub-window 6*a* from the 12 o'clock position adjacent to the sub-window 5*a*. In such way, when the mode indicator 67 points to the direction of the sub-window 6*a*, the tip of the mode indicator 67 reaches the outer edge or reaches near the outer edge so that a user can easily recognize the position pointed by the mode indicator 67 on the outer edge.

With respect to the outer edge of the sub-window 6*a*, the half circle on the 12 o'clock side is colored in a dark color, for example, in blue, and the other half circle on the 6 o'clock side is colored in a bright color, for example, in orange.

Further, the electronic timepiece 1*a* according to the embodiment can perform an alarm time informing operation, stopwatch operation and a timer counting operation. If any of these functions are being executed, the mode indicator 67 points to any one of the index "AL", index "SW" and index "TR" respectively indicating above functions. Switching between these functions and operation commands relating to these functions can be received by performing operation on the predetermined push button switches B1 to B4.

The opening 7 which exposes a date index of the date wheel 66 is provided at the 3 o'clock position. Further, a sub-window 8 which is smaller than the sub-window 4 is provided adjacent to the sub-window 4 which is provided at the 6 o'clock position, the sub-window 8 being arranged at the position in the 1:30 direction with respect to the sub-window 4. Inside the sub-window 8, a 24-hour hand 69 is provided so as to rotate.

Figure 9:
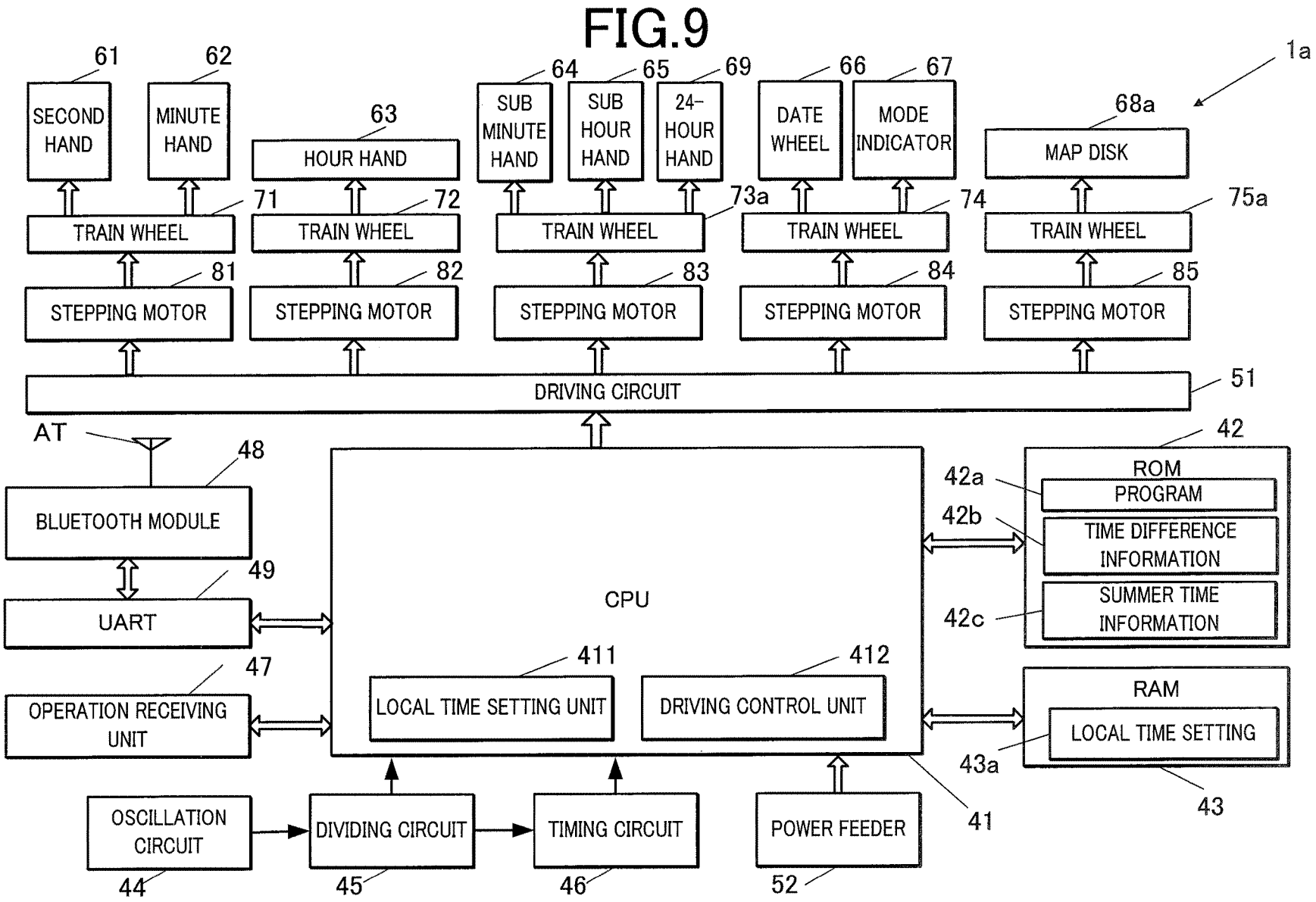
FIG. 9 is a block diagram showing a functional configuration of the electronic timepiece according to the second embodiment.

FIG. 9 is a block diagram showing a functional configuration of the electronic timepiece 1*a* according to the embodiment.

In the electronic timepiece 1*a*, the map disk 68*a* which rotates via the train wheel 75*a* as described above is provided instead of the map indicator 68 which rotates via the train wheel 75. Further, except for the train wheel 73*a* further makes the 24-hour hand 69 rotate in conjunction with the sub-minute hand 64 and the sub-hour hand 65, the configuration of the electronic timepiece 1*a* is the same as that of the electronic timepiece 1 according to the first embodiment. The same symbols are used for the same configurations and the description thereof is omitted.

The map disk 68*a* makes one rotation in the step movement of 96 steps so that each of the time zones in units of 15 minute can move to a predetermined position. At the time of normal time display, the stepping motor 85 is driven once every 15 minutes to rotate the map disk 68*a* for 3.75 degrees and the map disk 68*a* makes one full rotation in 24 hours so that the time zone of 0 o'clock be at the position in the 12 o'clock direction not taking summer time into consideration. That is, the map disk 68*a* is made to rotate so that the half of the map disk 68*a* close to midnight be arranged within the dark color (blue) circumference range and the other half of the map disk 68*a* close to noon be arranged within the bright color (orange) circumference range.

In the case where a local time is to be set, the mode indicator 67 points to a predetermined map indicating position (a predetermined rotation angle direction of the map disk 68*a*) at the border of the sub-window 6*a* and the sub-window 5*a*, here, the position where the line that goes through the centers of the sub-window 6*a* and the sub-window 5*a* crosses with the outer circumference of the sub-window 6*a*. Then, the map disk 68*a* is made to rotate so that the position corresponding to the set time zone matches the map indicating position pointed by the mode indicator 67. That is, whether the display of the map disk 68*a* is according to the present time or according to the local time setting can be discriminated by the indicating position pointed by the mode indicator 67.

The 24-hour hand 69 rotates at the speed which is half the speed of the sub-hour hand 65. That is, if the time indicated by the sub-minute hand 64 and the sub-hour hand 65 is 0:00, the 24-hour hand 69 points to the 12 o'clock direction and if the time indicated by the sub-minute hand 64 and the sub-hour hand 65 is 12:00, the 24-hour hand 69 points to the 6 o'clock direction. By the 24-hour hand 69 making one full rotation in one day, it is indicated whether the time indicated by the sub-hour hand 65 and the sub-minute hand 64 is in the morning or in the afternoon.

Next, the local time setting operation which is carried out manually in the electronic timepiece 1*a* according to the embodiment will be described.

Figure 10:
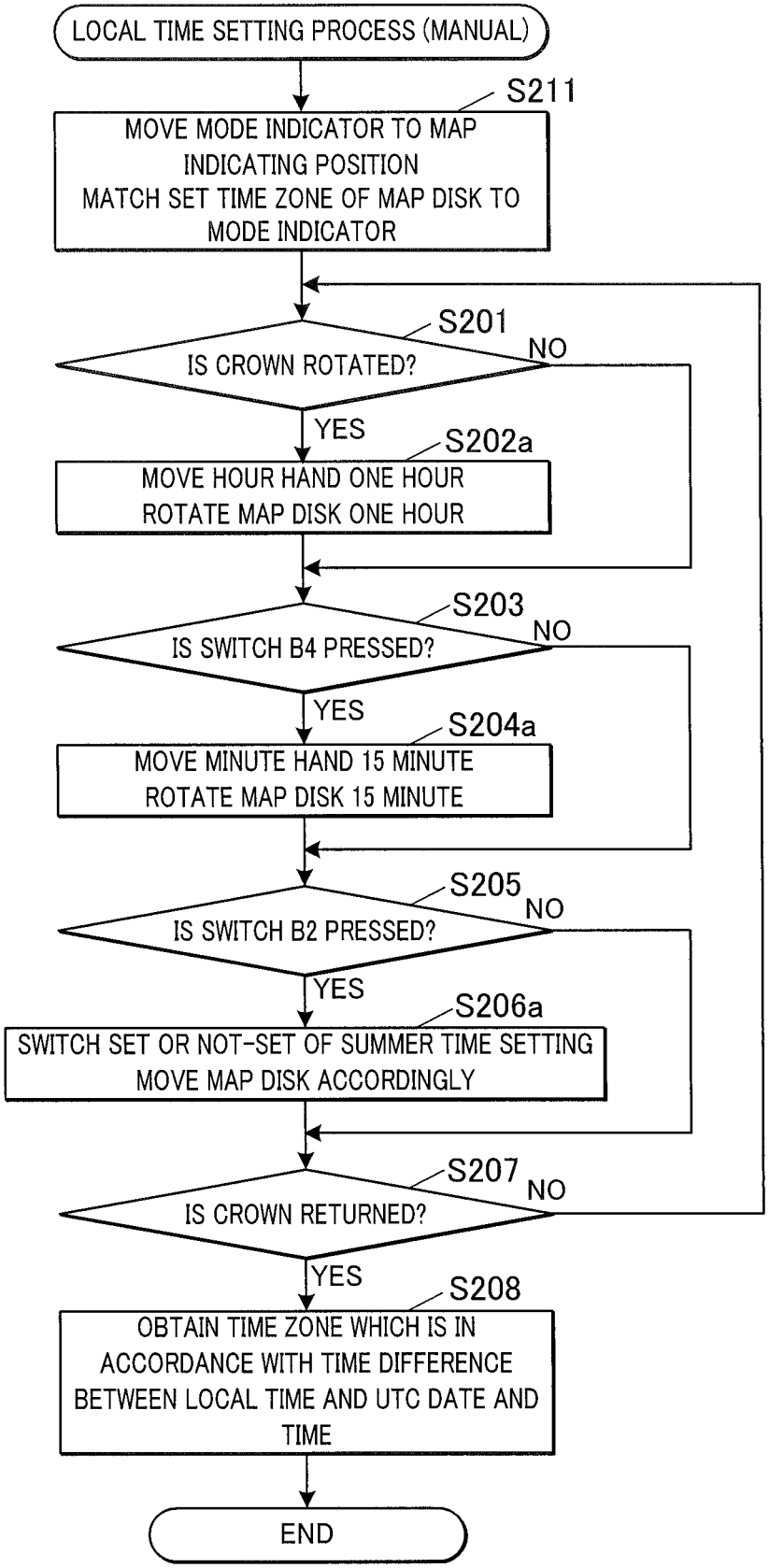
FIG. 10 is a flowchart showing a controlling procedure of a local time setting process (manual) which is executed in the electronic timepiece according to the second embodiment.

FIG. 10 is a flowchart showing a controlling procedure of a local time setting process (manual) which is executed in the electronic timepiece 1*a* according to the embodiment, the procedure being carried out by the CPU 41.

Comparing to the local time setting process (manual) according to the first embodiment shown in FIG. 5, this local time setting process (manual) has the process of step S211 added at the start of the procedure. Further, other than steps S202, S204 and S206 being respectively replaced by steps S202*a*, S204*a* and S206*a*, other processes are the same. Thus, the same symbols are used for the same processes and their detail description is omitted.

If the local time setting process (manual) is started, the CPU 41 outputs a control signal to the driving circuit 51 and moves the mode indicator 67 to the map indicating position. The CPU 41 further outputs a control signal to the driving circuit 51 to rotate the map disk 68*a* so as to match the time zone presently set to be displayed to the map indicating position (step S211).

If the CPU 41 determines that rotation of the crown C1 is detected in step S201 (step S201; YES), the CPU 41 outputs a control signal to the driving circuit 51 and proceeds the hour hand 63 for one hour and rotates the map disk 68*a* so as to proceed the time zone for one hour, the time zone being the one to be matched with the map indicating position (step S202*a*). Then, the process of the CPU 41 moves on to step S203.

If the CPU 41 determines that the pushing of the push button switch B4 is detected in step S203 (step S203; YES), the CPU 41 outputs a control signal to the driving circuit 51 and moves the minute hand 62 for 15 minutes and rotates the map disk 68*a* so as to proceed the time zone for 15 minutes, the time zone being the one to be matched with the map indicating position (step S204*a*). Then, the process of the CPU 41 moves on to step S205.

If the CPU 41 determines that the pushing of the push button switch B2 is detected in step S205 (step S205; YES), the CPU 41 switches the set or not-set of summer time and rotates the map disk 68*a* so that the time zone corresponding to the time shown by the minute hand 62 and the hour hand 63 matches the map indicating position with respect to the present time when summer time being set or summer time not being set (step S206*a*). Then, the process of the CPU 41 moves on to step S207.

In the electronic timepiece 1*a* according to the embodiment, the display of the mode indicator 67 indicating set or not-set of summer time and the display of the map indicating position cannot be carried out at the same time. Thus, for example, at the time when set or not-set of summer time is being switched, the mode indicator 67 can be made to point to the position indicating set or not-set of summer time (DST or STD) temporarily right after the switching, and the mode indicator 67 may be made to return to the map indicating position after a predetermined time has elapsed (for example, 1 second).

Figure 11A:
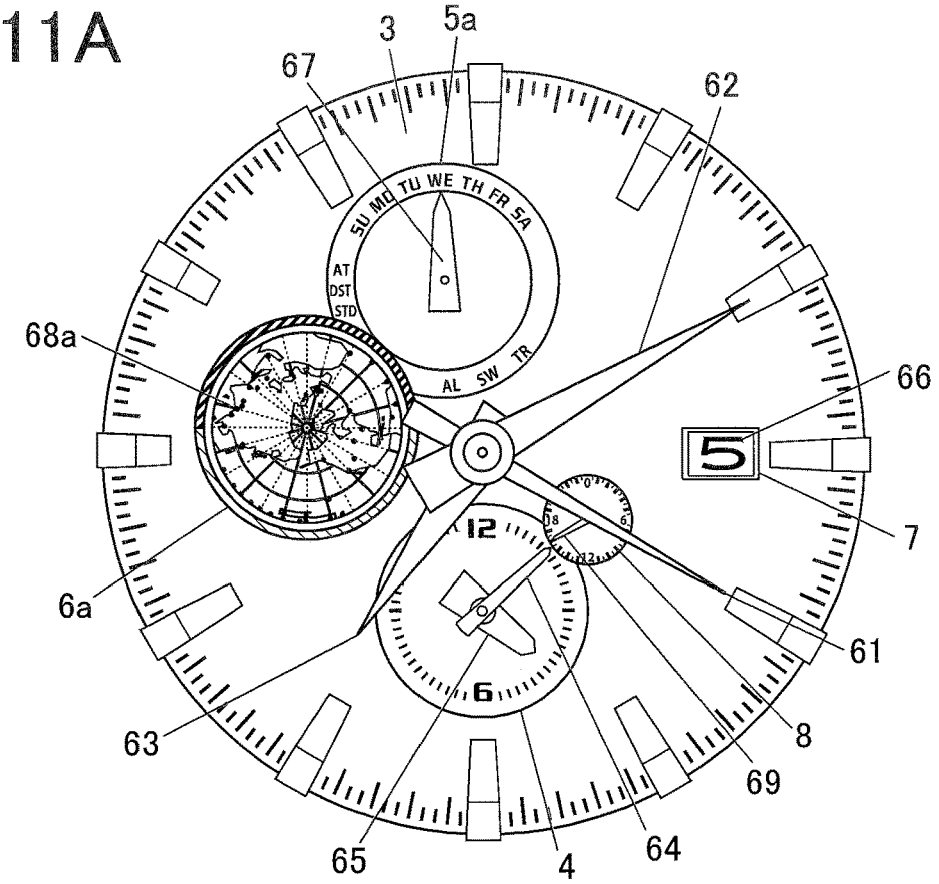
FIG. 11A shows a display example of when a local time setting process is being executed in the electronic timepiece according to the second embodiment.
Figure 11B:
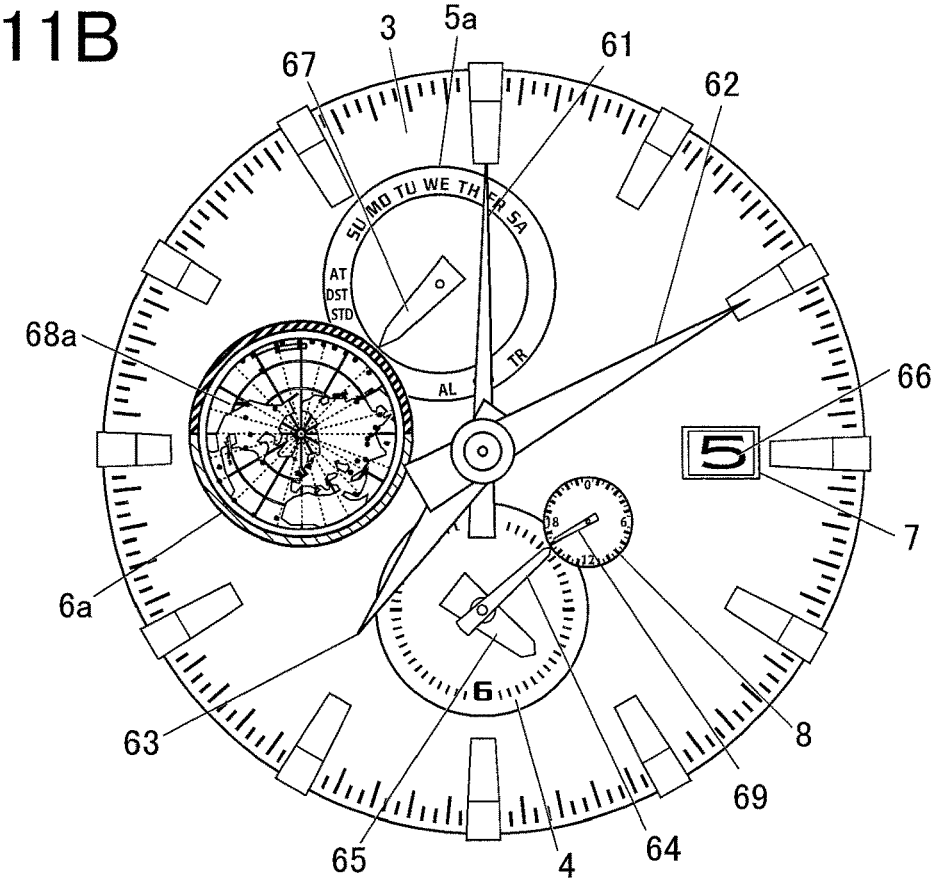
FIG. 11B shows a display example of when the local time setting process is being executed in the electronic timepiece according to the second embodiment.
Figure 12:
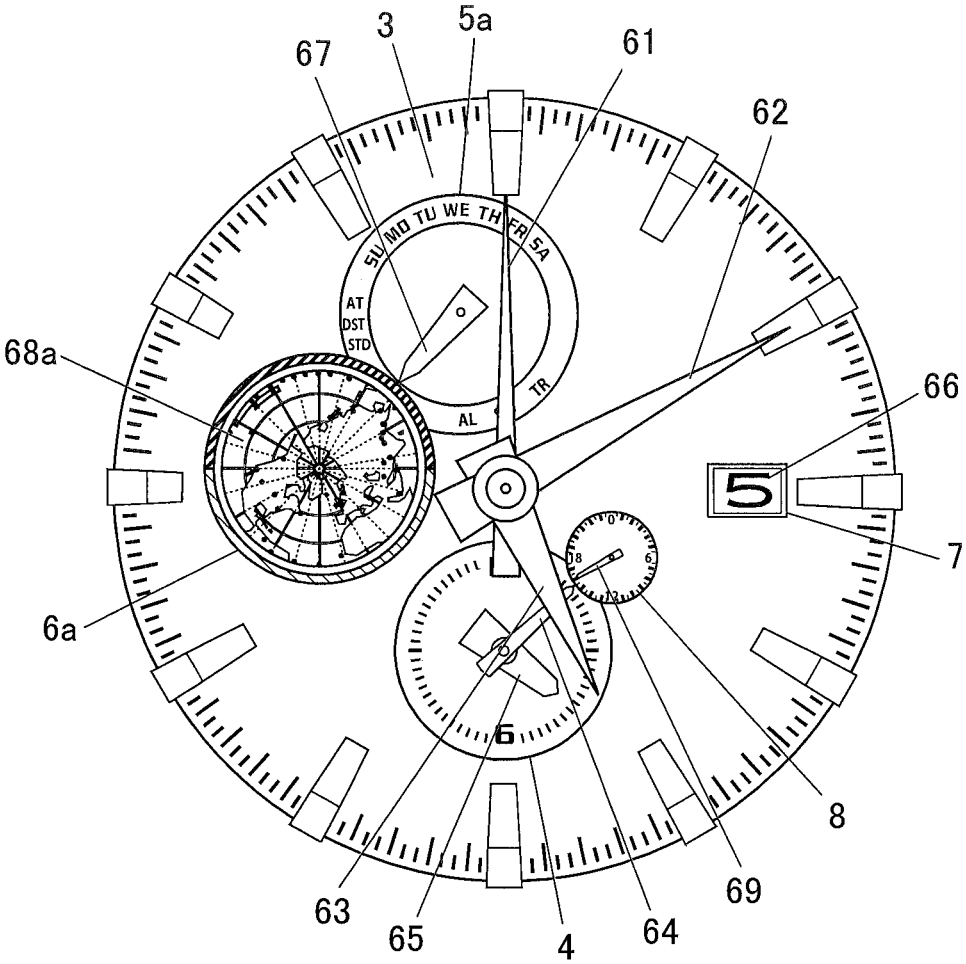
FIG. 12 shows a display example of when the local time setting process is being executed in the electronic timepiece according to the second embodiment.

FIGS. 11A, 11B and 12 show display examples of when the local time setting is being obtained in the electronic timepiece 1*a* according to the embodiment.

The time zone is set to Tokyo (UTC+9). If the local time is 7:10 (in the morning) on Wednesday, as shown in FIG. 11A, the minute hand 62, the hour hand 63 and the mode indicator 67 display this time and day of the week in a normal date and time display state. At this time, the map disk 68*a* is made to carry out a display so that Athens whose present local time (not considering summer time) is 0:10 on Wednesday indicates 12 o'clock.

If the local time setting process (manual) is started, as shown in FIG. 11B, the mode indicator 67 is made to move to the map indicating position, that is, to the direction pointing to the center of the sub-window 6*a*. The map disk 68*a* is made to rotate so that the position indicating Tokyo match to the map indicating position.

If rotation of the crown C1 is detected and if the rotation is for making the date and time go back from 2 hours (operation for going back 1 hour is detected twice), as shown in FIG. 12, the hour hand 63 is moved to the position of 5:10 which is going back 2 hours. The map disk 68*a* is made to rotate so that the position of Bangkok whose time zone is (UTC+7) matches to the map indicating position.

As described above, in the electronic timepiece 1*a* according to the second embodiment, the map image is formed on the rotatable map disk 68*a*, the map indicating position is pointed by the mode indicator 67 which is one of the plurality of indicators, the CPU 41 makes the map disk 68*a* rotate so as to make the position on the map indicating the time zone of the obtained local time setting match with the map indicating position (a predetermined rotation angle direction) in the state where the mode indicator 67 is pointing to the predetermined rotation angle direction of the map disk 68*a*, that is, the direction of the line connecting the centers of the sub-window 6*a* and the sub-window 5*a*.

In such way, the time zone can be similarly displayed appropriately also by rotating the map and matching to the predetermined map indicating position. Further, by not having an indicator overlapped on the map, the map can be seen clearly. Furthermore, since the map itself can rotate, expression can be more dynamic. Since the map is made to rotate and the mode indicator 67 is also responsible for pointing to the map indicating position not having an indicator used exclusively to point at the map, the number of stepping motors can be reduced and the operation efficiency can be improved.

Third Embodiment

Figure 13:
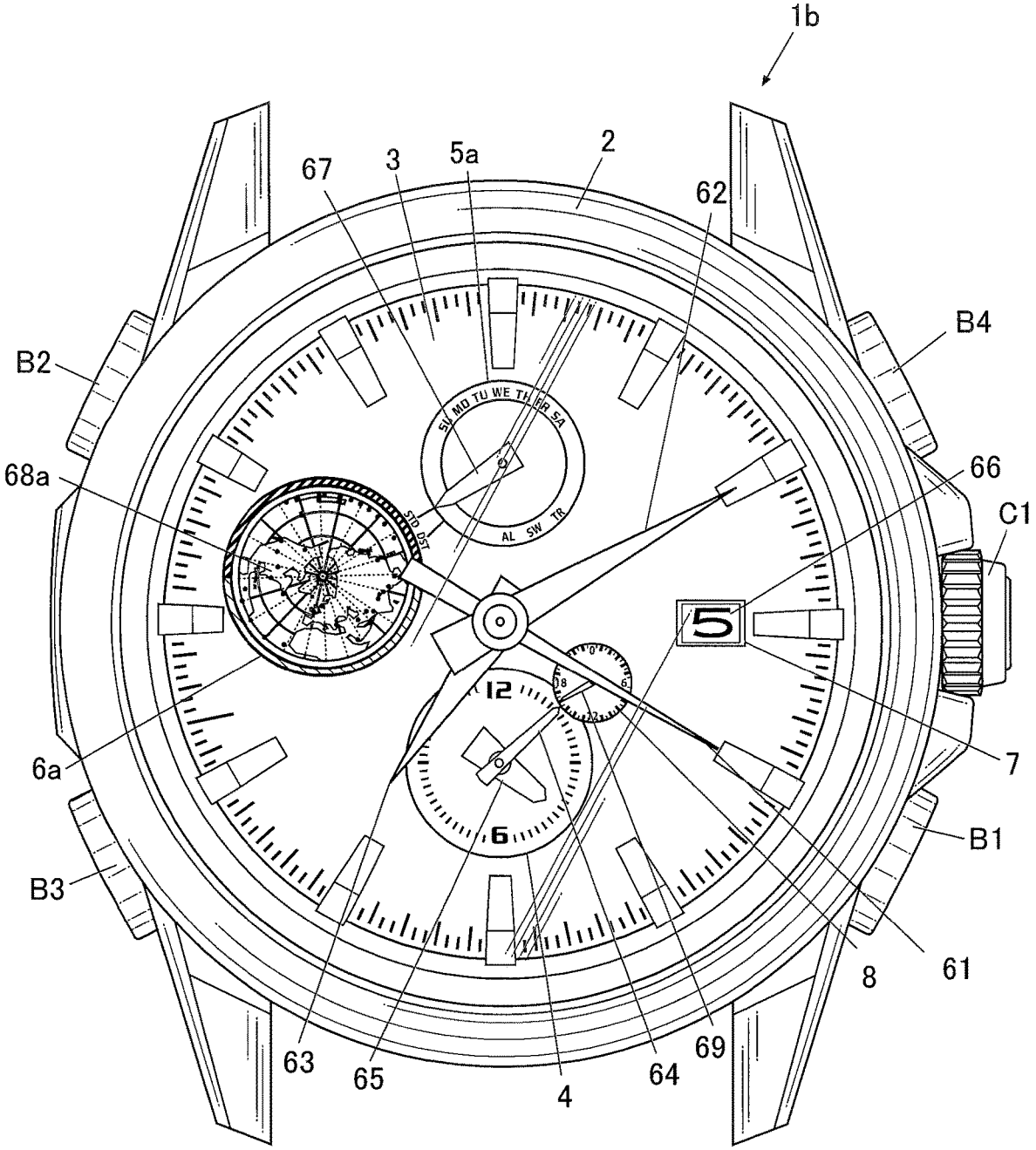
FIG. 13 is a front view of an electronic timepiece according to the third embodiment.

FIG. 13 is a front view of the electronic timepiece 1*b* according to the third embodiment.

In the electronic timepiece 1*b* according to the third embodiment, the sub-window 5*a* which is provided in the 12 o'clock side of the fixed dial 3 and the sub-window 6*a* which is provided at the 9 o'clock side of the fixed dial 3 are not in contact with each other. In stead, on the fixed dial 3, two fixed indexes "STD" and "DST" are provided at positions corresponding to the map indicating positions and two lines are formed from near the map indicating positions. The two lines are respectively connected to different positions at the outer circumference of the sub-window 5*a*. The line connected to the fixed index "STD" corresponds to when summer time is set and the line connected to the fixed index "DST" corresponds to when summer time is not set. Here, the fixed index "STD" is provided at the position proceeding by 1 hour in the sub-window 6*a* comparing to the position of the fixed index "DST".

Figure 14:
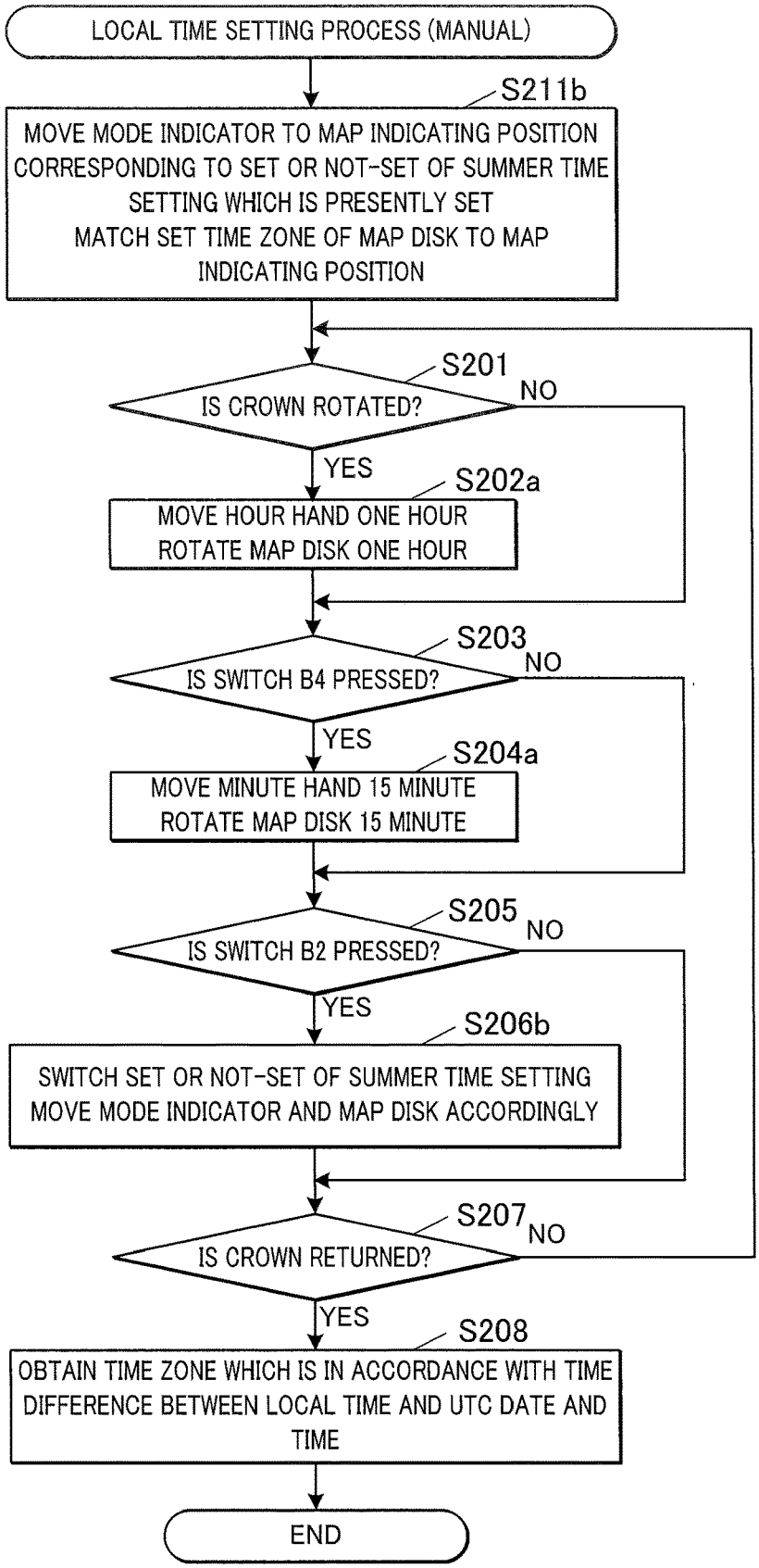
FIG. 14 is a flowchart showing a controlling procedure of a local time setting process (manual) which is executed in the electronic timepiece according to the third embodiment.

FIG. 14 is a flowchart showing a controlling procedure of a local time setting process (manual) which is executed in the electronic timepiece 1*b* according to the embodiment, the procedure being carried out by the CPU 41.

Comparing to the local time setting process (manual) which is executed in the electronic timepiece 1*a* according to the second embodiment, except for steps S211*a* and S206*a* being respectively replaced with steps S211*b* and S206*b* in this local time setting process (manual), other processes are the same. Thus, the same symbols are used for the same processes and their description is omitted.

If the local time setting process (manual) is started, the CPU 41 obtains the present local time setting, determines whether summer time is set or not-set, outputs a control signal to the driving circuit 51 and moves the mode indicator 67 to the map indicating position according to set or not-set of summer time. That is, the CPU 41 makes the mode indicator 67 point to the edge of the sub-window 5*a* corresponding to the line from the fixed index "DST" when summer time is set and makes the mode indicator 67 point to the edge of the sub-window 5*a* corresponding to the line from the fixed index "STD" when summer time is not set. The CPU 41 outputs a control signal to the driving circuit 51 and rotates the map disk 68*a* so that the position corresponding to the present position of the map disk 68*a* matches to the map indicating position pointed by the mode indicator 67, that is, match to either of the fixed index "DST" and the fixed index "STD" (step S211*b*).

Then, the process of the CPU 41 moves on to step S201.

If the CPU 41 determines that the pushing of the push button switch B2 is detected in the determining process of step S205 (step S205; YES), the CPU 41 switches the setting of set or not-set of summer time. The CPU 41 outputs a control signal to the driving circuit 51 and moves the mode indicator 67 so as to point to the line connected between the sub-window 5*a* and the sub-window 6*a* which is the other line not the line presently being pointed by the mode indicator 67 among the two lines connected between the sub-window 5*a* and the sub-window 6*a* (step S206*b*). At this time, the CPU 41 determines whether the time shift when summer time is being set is +1 hour. If the CPU 41 determines that the time shift is not +1 hour, the CPU 41 moves the map disk 68*a* so as to match the position corresponding to the time zone which involves (does not involve) time shift and the position of the fixed index corresponding to the pointing position of the mode indicator 67.

Then, the process of the CPU 41 moves on to step S207.

Modification

Figure 15A:
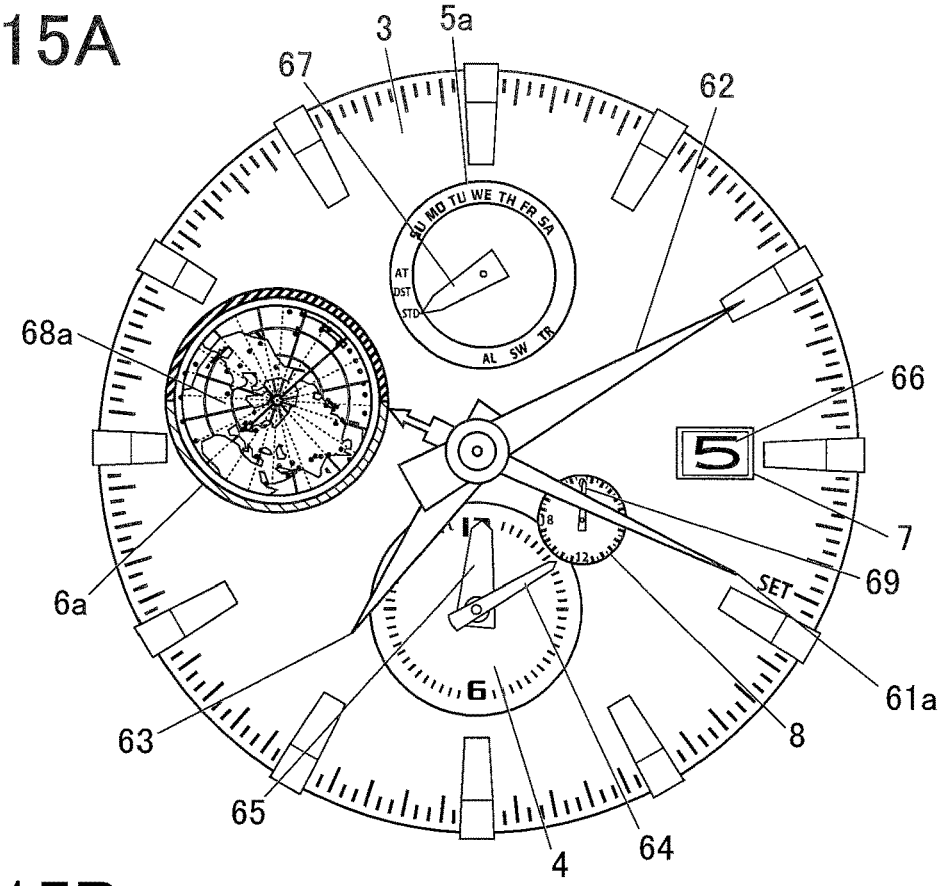
FIG. 15A shows the modification example 1 of the electronic timepiece according to the third embodiment.

FIG. 15A shows the modification example 1 of the electronic timepiece according to the third embodiment.

In the electronic timepiece according to the modification example 1 shown in FIG. 15, at the time when the second hand 61*a* points at the index "SET" provided at the position of 19 second, the end of the second hand 61*a* which is the opposite end of the end which points at the second (the base side end) points to the map indicating position of the sub-window 6*a*. At the time when the local time setting is being obtained, the second hand 61*a* is made to point at the index "SET". Here, the map disk 68*a* is made to rotate so that the position on the map disk 68*a* corresponding to Tokyo (UTS+9) matches to the map indicating position where the base side end of the second hand 61*a* points. The mode indicator 67 points to either of the index "DST" and the index "STD" according to the setting of set or not-set of summer time in the sub-window 5*a*. Here, the index "STD" corresponding to summer time not being set according to setting of Tokyo where summer is not set is pointed.

Figure 15B:
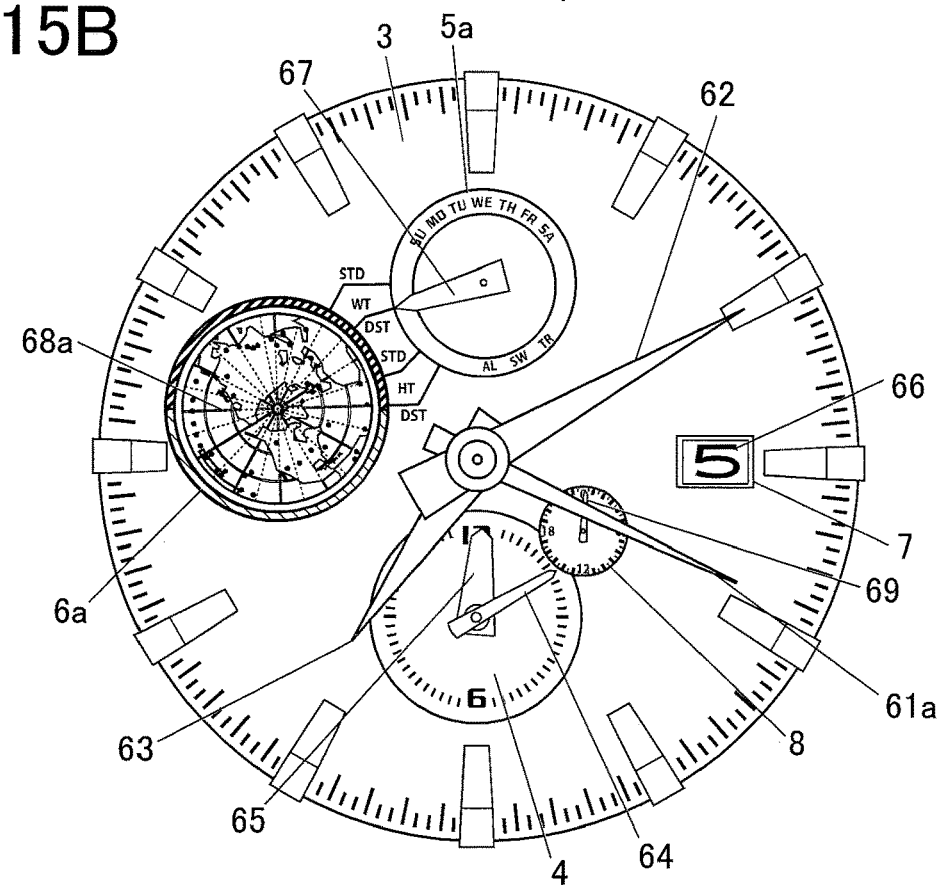
FIG. 15B shows the modification example 2 of the electronic timepiece according to the third embodiment.

FIG. 15B shows the modification example 2 of the electronic timepiece according to the third embodiment.

In the electronic timepiece according to the modification example 2 shown in FIG. 15B, four points to be pointed by the mode indicator 67 are set corresponding to map indicating positions. Two of these four points correspond to the two positions indicating summer time set or not-set (DST, STD) in the home city (HT) pointed by the second hand 61, the minute hand 62 and the hour hand 63. The other two of these four points correspond to the two positions (a plurality of positions) indicating summer time set or not-set (DST, STD) in a set city in the world time clock (WT) which is pointed by the sub-hour hand 65 and the 24-hour hand 69. Here, the four lines which connect to the map indicating positions and the four points at the sub-window 5*a* themselves are the fixed indexes indicating the map indicating positions.

In such case, for example, if the crown C1 is pulled out for one step and the set position (city) of the world time clock is changed, the mode indicator 67 is made to point to any of the positions according to set or not-set of summer time at the world time clock position. If the crown C1 is pulled out for two steps and the setting of home city is changed, the mode indicator 67 is made to point to any of the positions according to set or not-set of summer time in the home city. The map disk 68*a* is made to rotate so that the set time zone matches to the map indicating position which is pointed by the mode indicator 67. Here, in the case where the time zone of Paris (UTS+1) set in the world time clock (WT) is UTC+2 with summer time being set, the map disk

68*a* is made to rotate so that the position corresponding to Paris in the map disk 68*a* matches to the DST position of the world time clock.

As described above, in the electronic timepiece according to the third embodiment, the fixed indexes "STD" and "DST" indicating the predetermined rotation angle direction of the map disk 68*a* is provided as the map indicating units. Further, the mode indicator 67 which is one of the plurality of indicators is provided so as to point to the position corresponding to the fixed indexes (map indicating units), that is, edge positions on the sub-window 5*a* side of the two lines connected to the sub-window 5*a*. Furthermore, in the state where the position corresponding to the fixed index being pointed by the mode indicator 67, the CPU 41 rotates the map disk 68*a* so that the position on the map indicating the time zone relating to the obtained local time setting matches to the rotation angle direction indicated by the fixed index.

In such way, even if the arrangement of the sub-windows 6*a* and 5*a* does not allow the mode indicator 67 directly point to the position in the predetermined angle direction of the sub-window 6*a*, the lines or the like show relation so that the time zone of the date and time to which the map disk 68 is being set is easily shown by the mode indicator 67. Further, a user can easily know which time zone the map disk 68*a* is set to.

Further, the fixed indexes and the positions corresponding to the fixed indexes are separately set as "STD" and "DST" according to set or not-set of summer time. Thus, setting condition of set or not-set of summer time can be determined by looking at which corresponding position the mode indicator 67 is pointing to, and also, which time zone is being indicated can be determined easily according to the set or not-set of summertime. Further, since time shift due to summer time being set is often times 1 hour, there is no need to rotate the map disk 68*a* at the time of switching of set or not-set of summer time by the fixed indexes "STD" and "DST" being arranged by having a corresponding space therebetween.

The CPU 41 can set a plurality of cities, the home city and a city relating to the world time clock, as the positions target for obtaining local time. The edge positions on the sub-window 6*a* side of the lines which indicate map indicating positions and which correspond to the indicating positions to be pointed by the mode indicator 67 in the sub-window 5*a* are separately set for each of the plurality of cities.

Thus, the local time setting process in the electronic timepiece including the world time clock function can be done easily in the same manner as the normal local time setting process of the home city. Further, a user can easily know which setting is being carried out.

The present invention is not limited to the above described embodiments and various modifications can be made.

For example, in the above embodiment, the electronic timepiece 1 normally obtains the present time and the information on time zone, summer time rule and the like from an external device via Bluetooth. However, such information is not necessarily obtained from an external device. Only the present time may be obtained and the CPU 41 may determine the local time setting. Alternatively, the electronic timepiece 1 may not include the function to obtain such information from an external device. In such case, the electronic timepiece 1 may have the configuration to receive radio wave from a positioning satellite to obtain the correct date and time information.

In the third embodiment, the map indicating position relating to set or not-set of summer time and the corresponding positions are separately shown. However, only the positions to be pointed by the mode indicator 67 may be different and the map indicating position in the sub-window 6*a* may be the same position. Further, the fixed index "STD" is provided at the position proceeding by 1 hour with respect to the rotation of the map disk 68*a* comparing to the position of the fixed index "DST". However, such configuration is not limitative in any way. Furthermore, the electronic timepiece according to the present invention may not be a timepiece including the world time clock function.

In the above embodiment, any of the time zones is shown by the map indicator 68 being rotated on the map which is projected from a pole side. However, the map indicator 68 may move in an approximately parallel with respect to the map in which latitudes and longitudes bisecting each other in right angles.

The indicators 61 to 63 are not limited to rotate with respect to the indexes formed on the fixed dial 3. The indexes may be provided on the bezel or the casing 2. Alternatively, in the case where the 12 o'clock direction is obvious due to the shape of the casing 2 or the direction in which the band is worn when using as a watch, the indexes may not be provided at all.

The number of indicators, their arrangement, association with the stepping motors and their usage are not limited to what are described in the above embodiments. They can be modified as needed within the range the display according to the present invention can be performed. Further, the indicators used in the local time setting process (manual) are not limited to the minute hand 62 and the hour hand 63. Other indicators may be used in the local time setting process (manual).

In the above embodiments, movement of the hour hand 63 is operated by the crown C1 and movement of the minute hand 62 is operated by the push button switch B4. However, other operation method may be applied. Alternatively, only the changing in units of 15 minutes may be carried out by a single operation mechanism.

In the above embodiments, the UTC date and time is counted by the timing circuit 46 and the UTC date and time is converted into local time as needed on the basis of the local time setting to be obtained. However, the home time itself may be counted by the timing circuit 46 and the home time may be back calculated to obtain the UTC date and time and other world time clock time on the basis of the local time setting as needed.

In addition, specific configuration, content of operation, procedure and the like described in the above embodiments can be modified as needed within the scope of the present invention.

While the embodiment of the present invention is described, the scope of the present invention is not intended to be limited to the above-described embodiment, but is defined by the scope of the claims including the full scope of their equivalents.

What is claimed is:

1. An electronic device comprising:

one or more indicators; and a processor configured to:

determine a predetermined standard time based on counting by a timing circuit;

determine a local time at a first position in one of a plurality of time zones based on the predetermined standard time;

control a driving circuit to drive the one or more indicators to display the local time at the first position;

receive one or more user inputs corresponding to one or more predetermined units of the plurality of time zones;

control the driving circuit to incrementally drive the one or more indicators according to the one or more user inputs to indicate a corresponding local time at a second position corresponding to the local time at the first position;

determine a difference between the corresponding local time at the second position and the predetermined standard time;

determine a time zone of the second position based on the difference determined;

determine a local time at the second position based on the time zone of the second position determined;

control the driving circuit to drive the one or more indicators to display the local time at the second position determined; and control the driving circuit to drive the one or more indicators to display the time zone of the second position determined.

2. The electronic device according to claim 1, wherein the one or more user inputs correspond to:

the one or more predetermined units of the plurality of time zones; and whether a summer time rule is in effect at the second position, and wherein the processor is configured to determine the time zone of the second position based on the difference between the corresponding local time at the second position and the predetermined standard time, and whether the summer time rule is in effect at the second position.

3. The electronic device according to claim 2, wherein the one or more indicators comprise a mode indicator; and wherein the processor is configured to control the driving circuit to drive the mode indicator to display whether the summer time rule is in effect at the second position based on the one or more user inputs.

4. The electronic device according to claim 3, wherein the one or more indicators comprise a rotational disk on which a map is formed, and wherein the processor is configured to control the driving circuit to drive the rotational disk to rotate relative to the mode indicator such that the mode indicator identifies the time zone of the second position determined on the map.

5. The electronic device according to claim 1, wherein the one or more indicators comprise:

an hour hand; and a minute hand, and wherein the electronic device further comprises the driving circuit, and wherein the processor is configured to control the driving circuit to incrementally drive the hour hand and the minute hand according to the one or more user inputs to indicate the corresponding local time at the second position corresponding to the local time at the first position.

6. The electronic device according to claim 1, wherein the one or more indicators comprise a map indicator, and wherein the processor is configured to control the driving circuit to drive the map indicator relative to a map to display the time zone of the second position determined.

7. The electronic device according to claim 1, wherein the processor is configured to:

determine the local time at the second position based on:

the time zone of the second position determined; and a time elapsed between receiving the one or more user inputs and determining the time zone of the second position based on the one or more user inputs.

8. A method comprising:

determining, by a processor, a predetermined standard time based on counting by a timing circuit;

determining, by the processor, a local time at a first position in one of a plurality of time zones based on the predetermined standard time;

controlling, by the processor, a driving circuit to drive one or more indicators to display the local time at the first position;

receiving, by the processor, one or more user inputs corresponding to one or more predetermined units of the plurality of time zones;

controlling, by the processor, the driving circuit to incrementally drive the one or more indicators according to the one or more user inputs to indicate a corresponding local time at a second position corresponding to the local time at the first position;

determining, by the processor, a difference between the corresponding local time at the second position and the predetermined standard time;

determining, by the processor, a time zone of the second position based on the difference determined;

determining, by the processor, a local time at the second position based on the time zone of the second position determined;

controlling, by the processor, the driving circuit to drive the one or more indicators to display the local time at the second position determined; and controlling, by the processor, the driving circuit to drive the one or more indicators to display the time zone of the second position determined.

9. A non-transitory computer-readable storage medium storing instructions that cause a computer to at least:

determine a predetermined standard time based on counting by a timing circuit;

determine a local time at a first position in one of a plurality of time zones based on the predetermined standard time;

control a driving circuit to drive one or more indicators to display the local time at the first position;

receive one or more user inputs corresponding to one or more predetermined units of the plurality of time zones;

control the driving circuit to incrementally drive the one or more indicators according to the one or more user inputs to indicate a corresponding local time at a second position corresponding to the local time at the first position;

determine a difference between the corresponding local time at the second position and the predetermined standard time;

determine a time zone of the second position based on the difference determined;

determine a local time at the second position based on the time zone of the second position determined;

control the driving circuit to drive the one or more indicators to display the local time at the second position determined; and control the driving circuit to drive the one or more indicators to display the time zone of the second position determined.

* * * * *